US005456456A

United States Patent [19]

Abe et al.

[11] Patent Number: 5,456,456

[45] Date of Patent: Oct. 10, 1995

[54] PAPER FEEDING DEVICE HAVING PAPER INVERTING MEANS

[75] Inventors: Yuj Abe; Masuo Kawamoto; Masami Fuchi; Takeshi Uemura; Masahiko Miyazaki; Hiroyuki Ueda; Shinichi Kotera, all of Osaka, Japan

[73] Assignee: Mita Industrial Co., Ltd., Osaka, Japan

[21] Appl. No.: 89,140

[22] Filed: Jul. 8, 1993

[30] Foreign Application Priority Data

Jul. 13, 1992 [JP] Japan ..... 4-185563
Jul. 13, 1992 [JP] Japan ..... 4-185569

[51] Int. Cl.[6] ..... B65H 5/00

[52] U.S. Cl. ..... 271/10.09; 271/225; 271/186; 271/242

[58] Field of Search ..... 271/10, 126, 127, 271/225, 147, 160, 185, 184, 109, 242, 186; 355/219, 318

[56] References Cited

U.S. PATENT DOCUMENTS

| | | | |
|---|---|---|---|
| 4,397,541 | 8/1983 | Lopata et al. | 355/318 |
| 4,768,772 | 9/1988 | Ochiai et al. . | |
| 4,789,876 | 12/1988 | Miyai et al. . | |
| 4,828,245 | 5/1989 | Shimogawara | 271/227 |
| 4,839,690 | 6/1989 | Onoda et al. | 355/219 |
| 5,090,682 | 2/1992 | Takimoto | 271/225 |
| 5,189,471 | 2/1993 | Irihara et al. . | |

FOREIGN PATENT DOCUMENTS

| | | | |
|---|---|---|---|
| 232064 | 8/1987 | European Pat. Off. . | |
| 291943 | 11/1988 | European Pat. Off. . | |
| 389285 | 9/1990 | European Pat. Off. . | |
| 0104541 | 4/1989 | Japan | 271/242 |
| 0117153 | 6/1989 | Japan | 271/225 |
| 1583168 | 1/1981 | United Kingdom . | |
| 2127383 | 4/1984 | United Kingdom | 271/10 |
| 2126991 | 4/1984 | United Kingdom | 271/10 |

OTHER PUBLICATIONS

Patent Abstracts of Japan vol. 10, No. 12 (P–421) (2069) 17 Jan. 1986 & JP–A–60 168 162 (Konishiroku Shashin Kogyo) 31 Aug. 1985.

*Primary Examiner*—H. Grant Skaggs
*Attorney, Agent, or Firm*—Jordan and Hamburg

[57] ABSTRACT

A paper feeding device is usable in an image forming apparatus, and is provided with a paper supplier for supplying a copy paper sheet and a paper inverting portion for inverting the supplied copy paper sheet. The inverting portion has an inner guide surface curved substantially in C-shape. This paper feeding device is simple in construction and assure smooth paper inverting.

27 Claims, 18 Drawing Sheets

PAPER FEEDING DEVICE HAVING PAPER INVERTING MEANS

BACKGROUND OF THE INVENTION AND RELATED ART STATEMENT

This invention relates to a paper feeding device for use in an image forming apparatus such as copying machine, facsimile machine.

There have been known an image forming apparatus provided with a paper feeding device including an inverting portion for inverting the copy paper sheet fed from a paper cassette and feeding the inverted sheet to a registration roller pair to reduce the size of apparatus.

There has been a paper feeding device having a circular guide member and an inverting roller provided in the circular guide member. However, such paper feeding device requires a driving portion and drive transmission for the inverting roller, which makes it impossible to reduce the size of apparatus.

Also, there has been known a paper feeding device having an inverting portion in which an outer guide member and an inner guide member, these member having a predetermined curved form, are opposed to each other at a specified space.

However, such conventional paper feeding devices are complicated in construction and thus have problems of feeding copy paper sheets improperly and involving jams. Specifically, the copy paper sheet ted From the paper cassette is likely to get entangled on Feeding rollers due to a bending of the leading end of copy paper sheet, causing a jam. Also, a jam is likely to occur in an inlet portion of the inverting portion. Further, the inverted copy paper sheets have on different positions the bending portion provided in the inverting process, resulting in often the problem that the registration roller pair fails to nip the leading end of copy paper sheet.

In addition, removing of jammed sheet is not easy. The inverted copy paper sheet has a resilient against to the inverting. This resilient causes a trailing end of the inverted copy paper sheet to hit a nearby member when the copy paper sheet leaves the paper cassette, consequently making nuisance noises.

Also, the conventional image forming apparatus is provided with a paper cassette having a paper push-up member made of a metal, involving in jams on the account of the metal push-up plate. Specifically, the metal paper push-up member is provided in a forward portion of a cassette casing of a resin material. One end of the metal paper push-up member is rotatably attached to the cassette casing while the other end is biased upwards by a spring. A leading end of a stack of copy paper sheets placed in the cassette casing is biased upward by the other end of the metal paper push-up member being biased upward. When the cassette carrying the stack of copy paper sheets is mounted on the apparatus, a top surface of the stack of copy paper sheets comes into pressing contact with the feeding roller by the upward biased push-up member. Being driven, the feeding roller feeds copy paper sheets sequentially from uppermost copy paper sheet.

In this feeding of copy paper sheets, however, electrostatic charges occurs on copy paper sheets due to friction between them to attract sheets to each other, involving multifeed. Further, such electrostatic attraction will occur in a downstream portion of the paper feeding device. The electrostatic charges cannot be grounded because the push-up member is made of metal but the cassette casing is made of resin. Accordingly, there has been the motivation of grounding the electrostatic charges on copy paper sheets placed in a paper cassette by a simpler construction.

It is an object of the present invention to provide a paper feeding device which has overcome the above-mentioned problems.

It is another object of the present invention to provide a paper feeding device which is compact and simple in construction, and can assuredly prevent jams.

SUMMARY OF THE INVENTION

Accordingly, a paper feeding device of the present invention being usable in an image forming apparatus, comprises paper supplying means for supplying a copy paper sheet; and a paper inverting portion for inverting the supplied copy paper sheet, the inverting portion having an inner guide surface curved substantially in C-shape. This apparatus which is simple in construction assures smooth and easy inverting.

The paper inverting portion may be formed with a step between a front end and an intermediate portion thereof and a step between the intermediate portion and a rear end thereof, the step being gradually smaller in a downstream direction. In this apparatus, the steps keep a possible bent portion at a corner of a leading end of the copy paper sheet from coming into contact with an upstream end (inlet end) on the inner guide surface of the inverting portion, which assures smooth inverting and prevents a jam.

The paper inverting portion may be provided with a plurality of ribs arranged in a widthwise direction of the copy paper sheet, the rib having an inner guide surface curbed substantially in C-shape. These ribs reduce the friction of the inverting copy paper sheet to the inner guide surface of the inverting portion, assuring smooth inverting to prevent a jam.

The paper inverting portion may be provided with a flat surface portion in a downstream thereof. The flat surface restricts the feeding direction of the inverted copy paper sheet, thus eliminating the likelihood of jamming at the outlet portion of the inverting portion.

The paper inverting portion may be provided with pivot pins on front and rear walls of the inverting portion, the pivot pin being adapted for pivotally mounting the paper inverting portion on the image forming apparatus. Accordingly, the paper inverting portion is pivotable on the image forming apparatus. Accordingly, this pivotable inverting portion can provide easy removing of a jammed copy paper sheet, if any.

The inverting portion may be provided with a roller near and along an upstream end of the paper inverting portion, the roller facing the inner guide surface of the paper inverting portion. This roller renders the copy paper sheet bent at a fixed position, and also renders the leading end of the copy paper sheet always come into contact with the inner guide surface of the inverting portion. Accordingly, the copy paper sheet is smoothly and assuredly inverted along the inner guide surface.

Also, it may be preferable to use a coil spring as a shaft of the roller. This reduces the weight of the paper feeding device.

It may be preferable to provide a guide member on an upstream of the roller and along the upstream end of the paper inverting portion, the guide member facing the inner guide surface of the paper inverting portion. This guide member keeps the copy paper from warping when the leading end of the copy paper sheet comes into contact with the inner guide surface of the inverting portion. Accordingly, the copy paper sheet is smoothly inverted, which thus prevents a jam.

It may be preferable to provide an elastic member on an upstream end of the inner guide surface of the paper inverting portion. This elastic member keeps the trailing end of the copy paper from directly hitting the inner guide surface, which thus prevents noises.

The paper supplying means may be constructed by paper storage means for storing the copy paper sheet; feed roller means provided in the widthwise direction of the copy paper sheet and made in contact with the copy paper sheet stored in the paper storage means for feeding the copy paper sheet to the paper inverting portion: and paper guide means provided on an downstream of and lower than the feed roller means and upper than the lowermost surface of the feed roller means, the paper guide means extending to such a downstream position as to prevent the copy paper sheet from bending when a leading end of the copy paper sheet comes into contact with the inner guide surface of the paper inverting portion. This paper guide means smoothly regulates the feeding of the copy paper sheet from the paper storage, and prevents jams assuredly, Moreover, according to the present invention, a paper feeding device is mountable on an image forming apparatus having grounding means, and comprises paper storage means for storing copy paper sheet; paper push-up means provided on the paper storage means for pushing the copy paper sheet upward, the paper push-up means being made of a conductive material and having a projection electrically connectable to the grounding means when the paper storage means is mounted on the image forming apparatus. The electrical charges between copy paper sheets is grounded by the simple construction, eliminating electrical attraction between copy paper sheets, or between the copy paper sheet and feeding members. Thus, the feeding of copy paper sheets can be performed smoothly and assuredly.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 21:
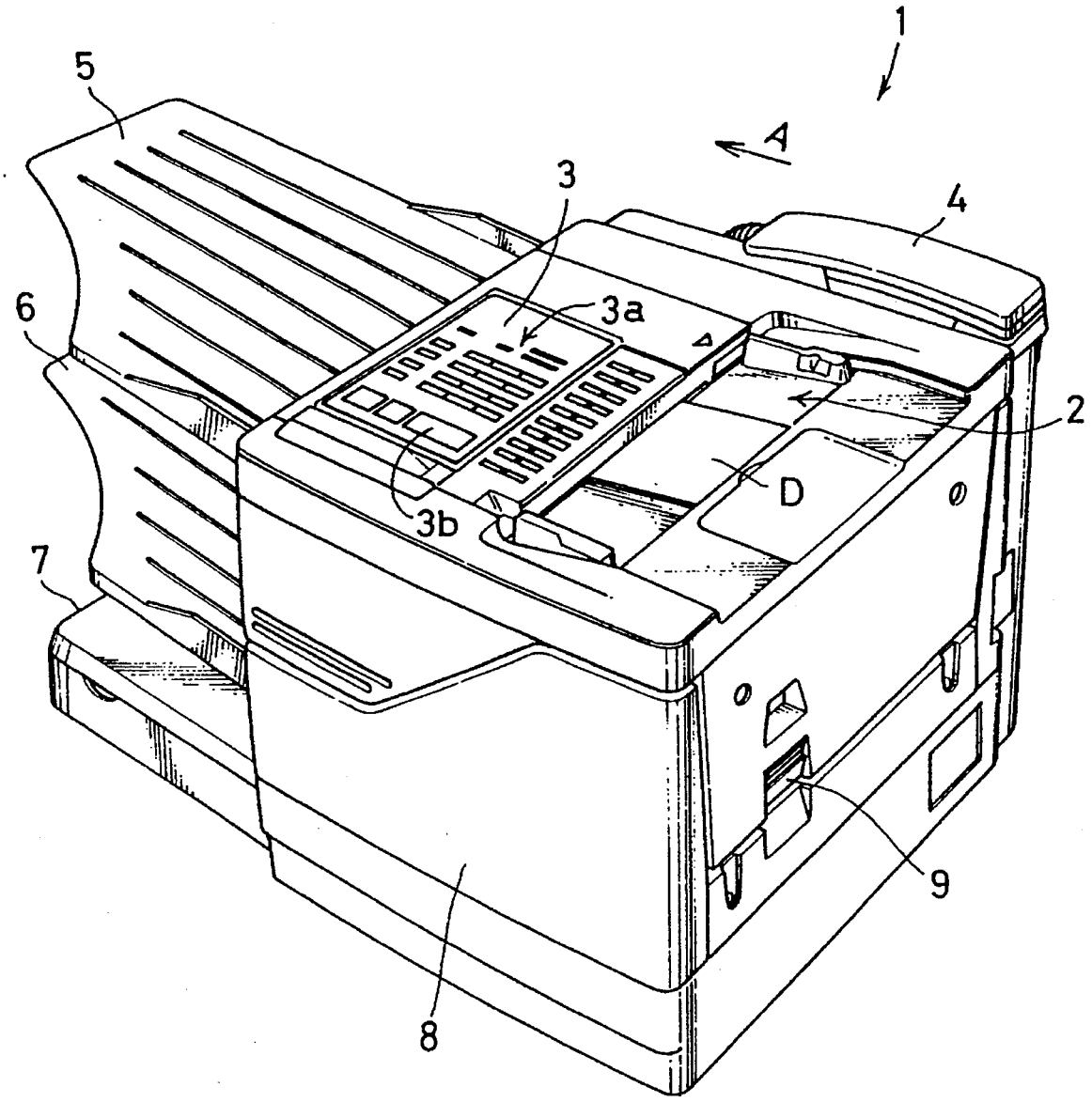
FIG. 21 is a perspective view showing an external appearance of the facsimile machine embodying the present invention.

FIG. 21 is a perspective view showing an external appearance of a facsimile machine embodying the present invention.

Provided with the functions of dedicated facsimile transmission and image forming, the facsimile machine shown in FIG. 21 not only forms a copy image of a transmitted image but also an image of an original document on a cut copy sheet.

The facsimile machine has a main body 1. As shown in FIG. 21, the main body 1 is formed with a document feeder tray 2 on a right portion of a top surface thereof, a control panel 3 on a left portion of the top surface, and a wired telephone handset 4 at a rear end of the top surface. The control panel 3 includes numeric keys, function keys 3*a* for setting various functions and operating conditions required for facsimile transmission and image forming, and a display window 3*b* for displaying set parameters and other information.

The main body 1 incorporates image reading means and image forming means individually constructed in the form of discrete modules. The image forming means further comprises a plurality of detachable sub-units as will be discussed later. The image forming means itself can be dismounted from and mounted into the main body 1 after opening its front cover 8.

On a left side of the main body 1, there are provided an document discharge tray 5 for receiving an original document read by the image reading means and a copy sheet discharge tray 6 for receiving a copy sheet bearing an image formed by the image forming means. On a lower left side of the main body 1 is mounted a copy sheet cassette 7 for holding a stack of standard-size cut copy sheets. The copy sheet is fed from the copy sheet cassette 7 to the image forming means.

As will be seen later, the main body 1 is divided into an upper body and a lower body. The upper body is connected to the lower body in such a manner that a right side of the upper body can be turned about a pivot shaft on a left side. The right side of the upper body is normally locked to the lower body by a locking mechanism. The upper body is so biased upward a spring as to flip up in the counterclockwise direction when the lock is released. Mechanisms for assembling and locking the upper and lower bodies will be discussed later in further detail.

There is provided a release lever 9 for releasing the lock between the upper and lower bodies on the right side of the main body 1. The locking mechanism is released when the release lever 9 is pushed upward. The right side of upper body flips up and swings in the counterclockwise direction with the aid of springs to open the right side of the main body 1.

Figure 3:
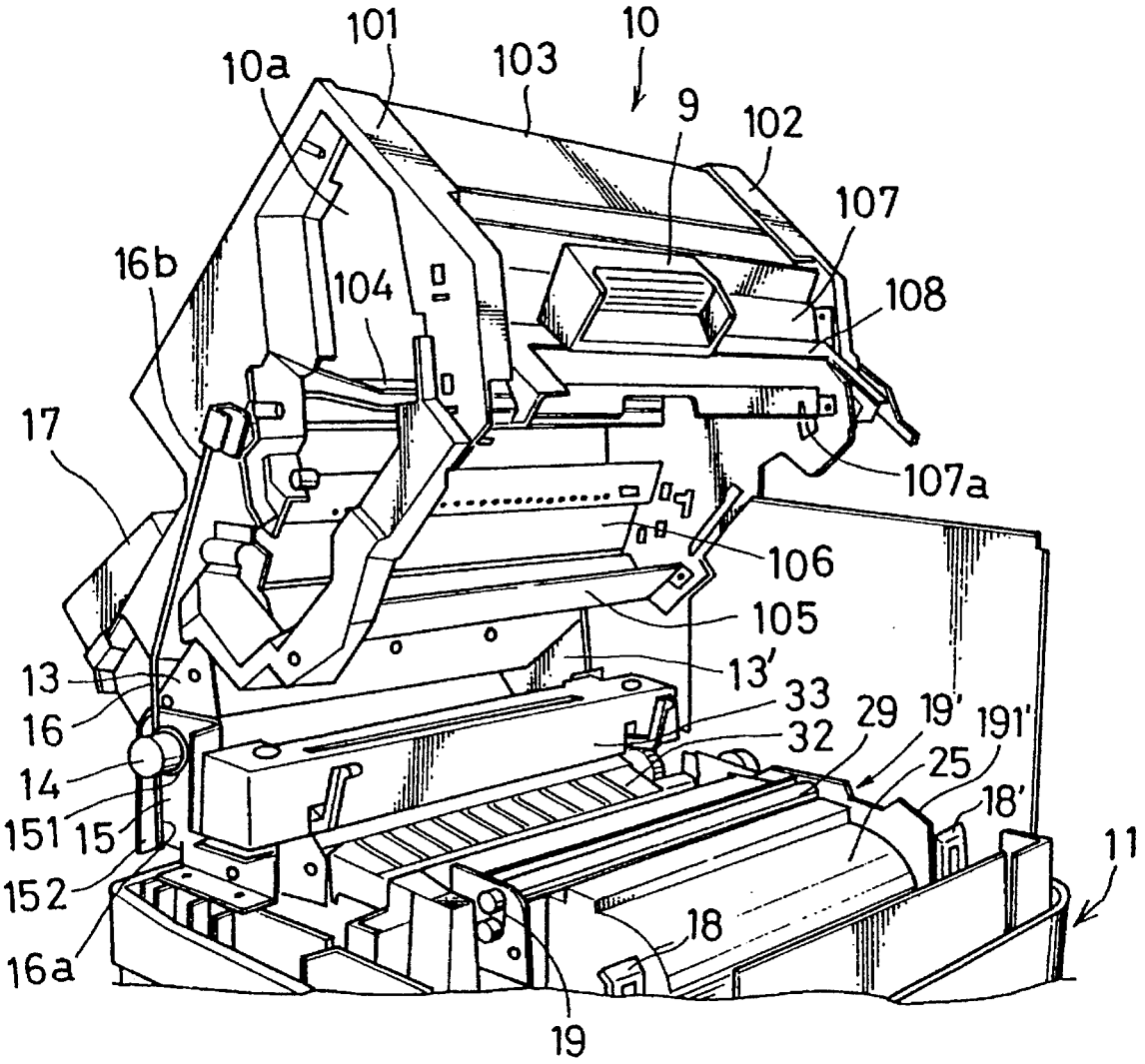
FIG. 3 is a perspective view showing an interior of the machine with its upper and lower bodies opened wide.
Figure 4:
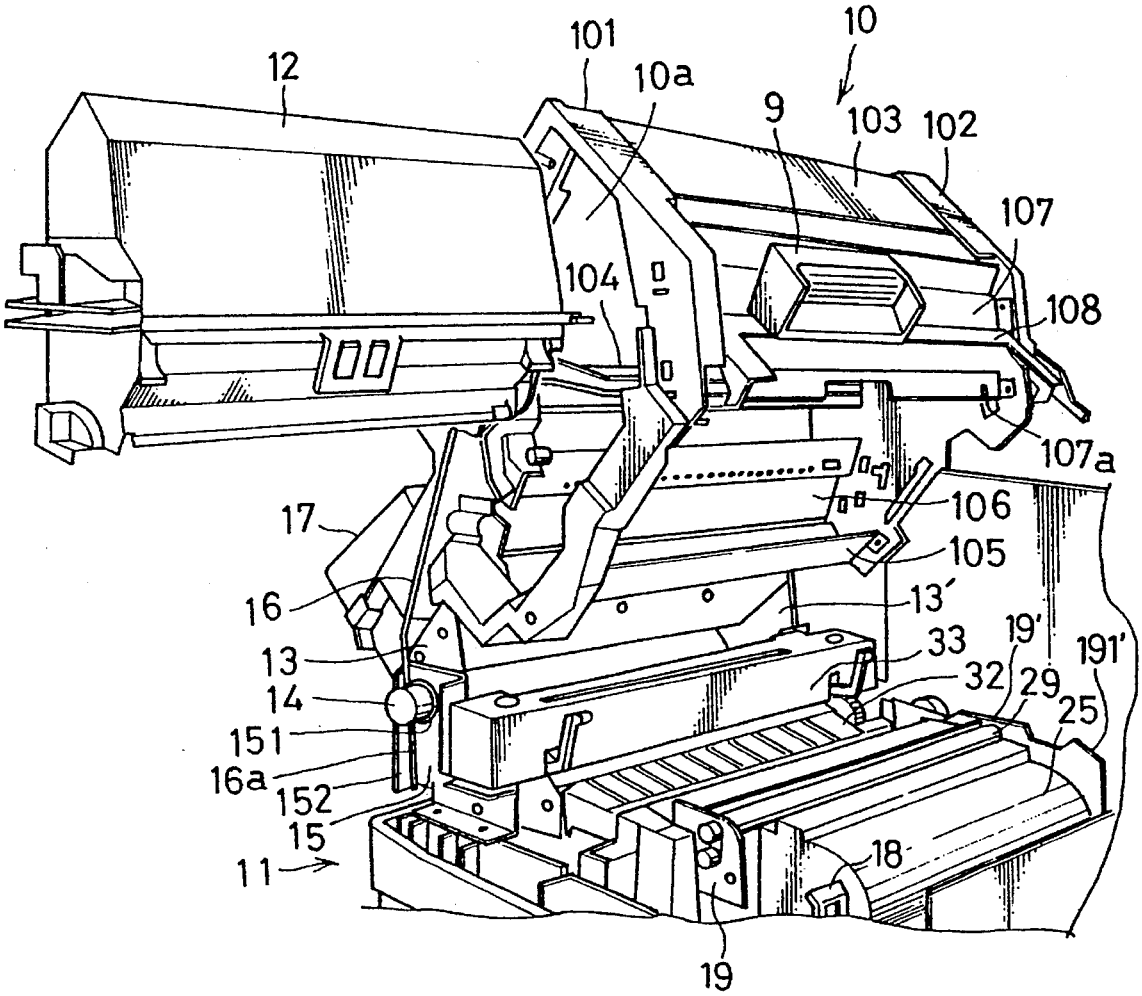
FIG. 4 is a perspective view similar to FIG. 3, but additionally showing a developing unit.

FIG. 3 is a perspective view showing an interior of the main body 1 with its upper body 10 and lower body 11 opened wide. FIG. 4 a perspective view similar to FIG. 3, but additionally showing a developing unit 12, a part of the image forming means.

Major structural members of the upper body 10 are a front frame member 101, a rear frame member 102 and a plurality of reinforcing members 103 to 106. The front frame member 101 and rear frame member 102 are usually one-piece molded resin members while the reinforcing members 103 to 106 are metal plates to reinforce the connection between the front frame member 101 and rear frame member 102 and prevent them from twisting. The upper body 10 has an image reading means 17 mounted at an upper left position. The upper body 10 is designed in such a manner that a developing unit 12 and the other parts of the image forming means can be inserted into the main body through the front frame member 101 . As will be described later, the front and rear frame members 101 and 102 are formed with flanges, each having specified width in the longitudinal direction. These flanges are adapted for guiding the developing unit 12 as it is inserted.

Figure 1:
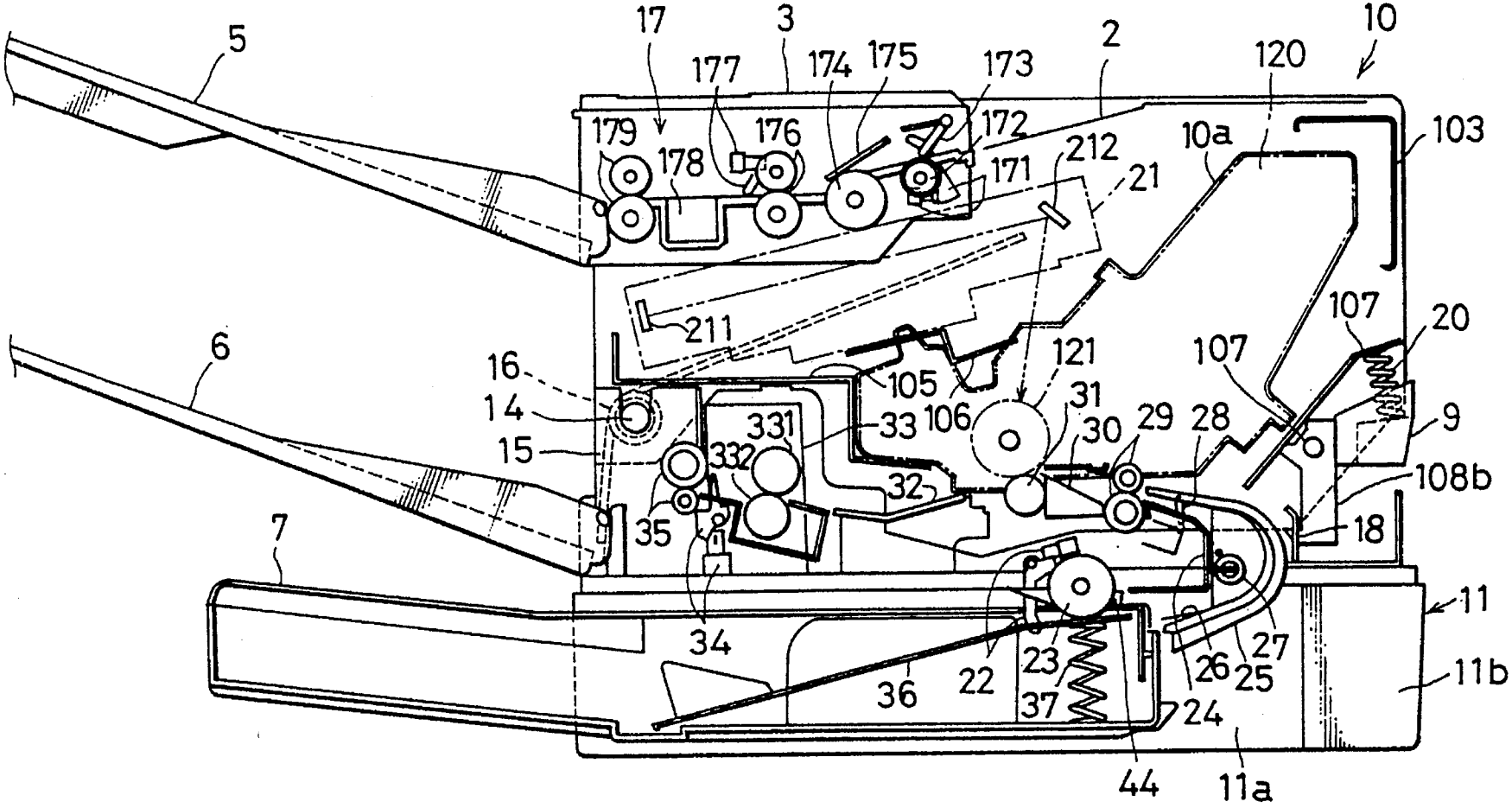
FIG. 1 is a diagram schematically showing an internal construction of a facsimile machine, one preferred embodiment of the present invention, in a closed position.

The reinforcing member 103 is formed into an L-shaped cross section as seen in FIG. 1. The reinforcing member 104 serves also as fixing plate for the front frame member 101 and rear frame member 102. The reinforcing members 105 and 106 serve also as fixing plate for an optical unit 21 shown in FIG. 1, which is a part of the image forming means to be described later. The reinforcing member 105 further serves as insertion guide plate for internal elements. A positioning member 107 is provided to set a lowermost position of the upper body 10 as it descends on the lower body 11. Indicated at 108 is a hook member for locking the upper body 10 to the lower body 11. The hook member 108 also serves as fixing plate for the release lever 9. The construction and operation of the positioning member 107 and hook member 108 will be described later.

Figure 5A:
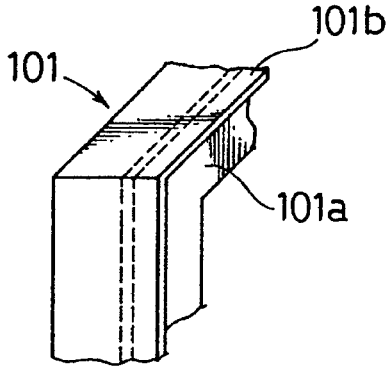
FIG. 5A is a perspective view showing a portion of a frame member of the upper body.
Figure 5B:
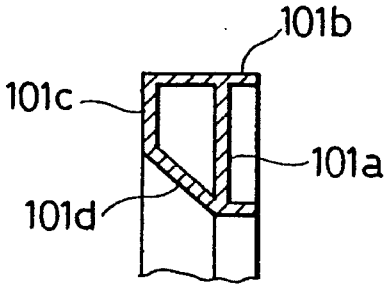
FIG. 5B is a sectional view of the portion shown FIG. 5A.
Figure 6A:
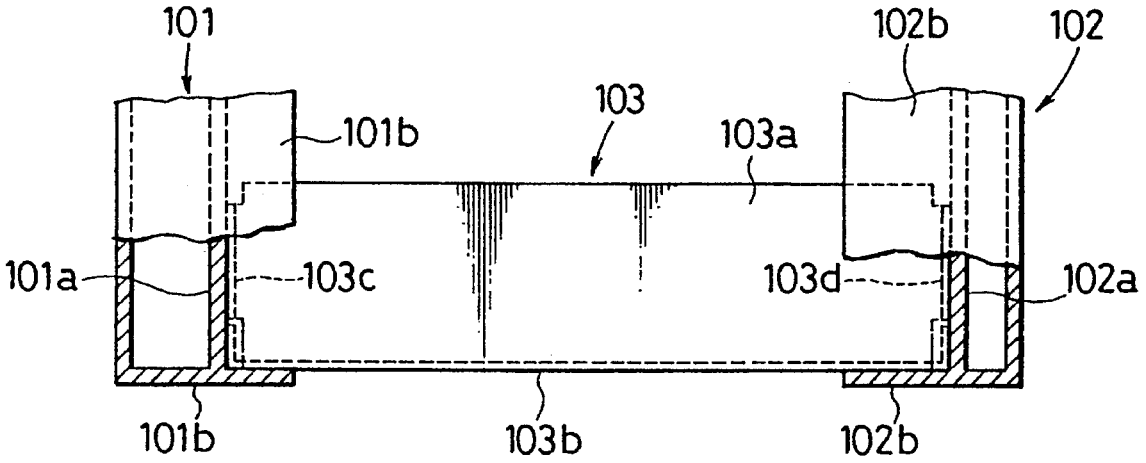
FIGS. 6A and 6B are a plan view and a right side view partially in section, respectively, showing a connection of front and rear frame members by a reinforcing member.
Figure 6B:
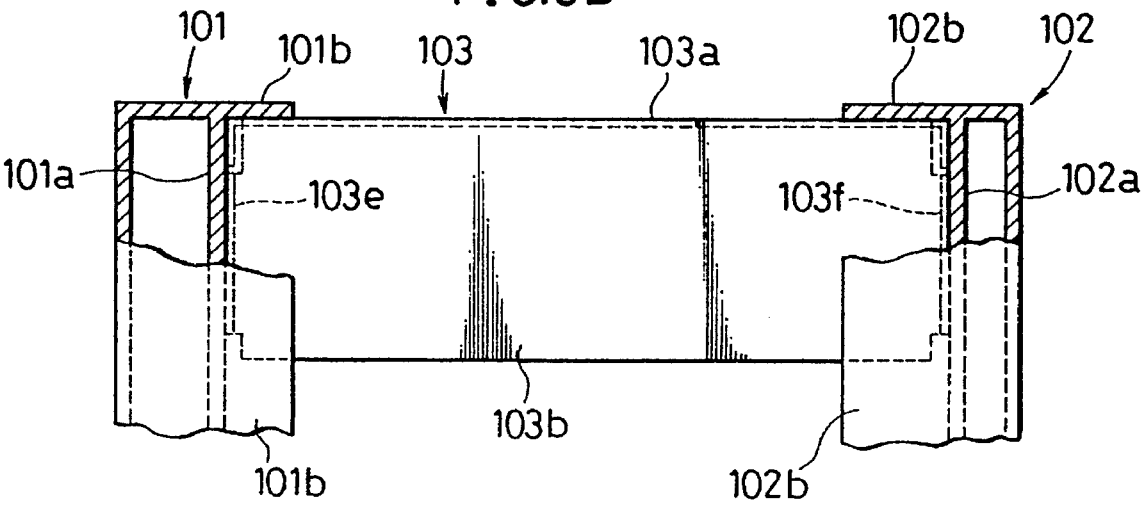

FIGS. 5A and 5B are a fragmentary perspective view and a fragmentary cross sectional view, respectively, showing the shape of the front frame member 101. FIGS. 6A and 6B are a plan view and a right side view partially in section, respectively, showing how the front frame member 101 and rear frame member 102 are connected by the reinforcing member 103.

The front frame member 101 has a specified width and formed with a flange portion 101*b* on a periphery of an inner face portion 101*a*. The flange portion 101*b* is perpendicular to the inner plate portion 101*a*. In an intermediate portion of the front frame member 101 is formed a passage 10*a* through which the internal elements are inserted. An outer face portion 101*c* has a fan-like cross section to give a greater opening to the front of the passage 10*a* compared to the inside. Since the outer face portion 101*c* is broadening outward, it will serve as guide when inserting internal elements.

Like the front frame member 101, the rear frame member 102 has a specified width and is formed with a flange portion 102*b* on a periphery of the inner face portion 102*a*. The flange portion 102*b* is perpendicular to the inner face portion 102*a*. However, the rear frame member 102 has no opening.

As seen in the above description, the front and rear frame members 101 and 102 have a specified width. The passage 10*a* is defined by the outer face portion 101*c* serving as guide and is widened outward. Accordingly, the internal elements can be easily loaded to and removed from the upper body 10.

On the other hand, the reinforcing member 103 is formed by bending a single metal plate. The plate 103 has an upper face portion 103*a* which is a part of the top of the upper body 10, a right face portion 103*b* which is a part of the right side surface of the upper body 10, and a front face portion 103*c* and a rear face portion 103*d* which are connected to the inner face portion 101*a* of the front frame member 101 and the inner face portion 102*a* of the rear frame member 102 respectively, as shown in FIGS. 6A and 6B.

The front face portion 103*c* and rear face portion 103*d* of the reinforcing member 103 are connected to the inner face portion 101*a* of the front frame member 101 and the inner face portion 102*a* of the rear frame member 102, respectively. Further, both ends of the upper face portion 103*a* and both ends of the right face portion 103*b* are connected to the flange portions 101*b* and 102*b* of the front frame member 101 and rear frame member 102. As seen above, the front frame member 101 and rear frame member 102 are united to each other by the reinforcing member 103 by the inner face portions 101*a* and 102*a*, and the flange portions 101*b* and 102*b*. This construction effectively prevents deformation due to torsional stresses.

Figure 7:
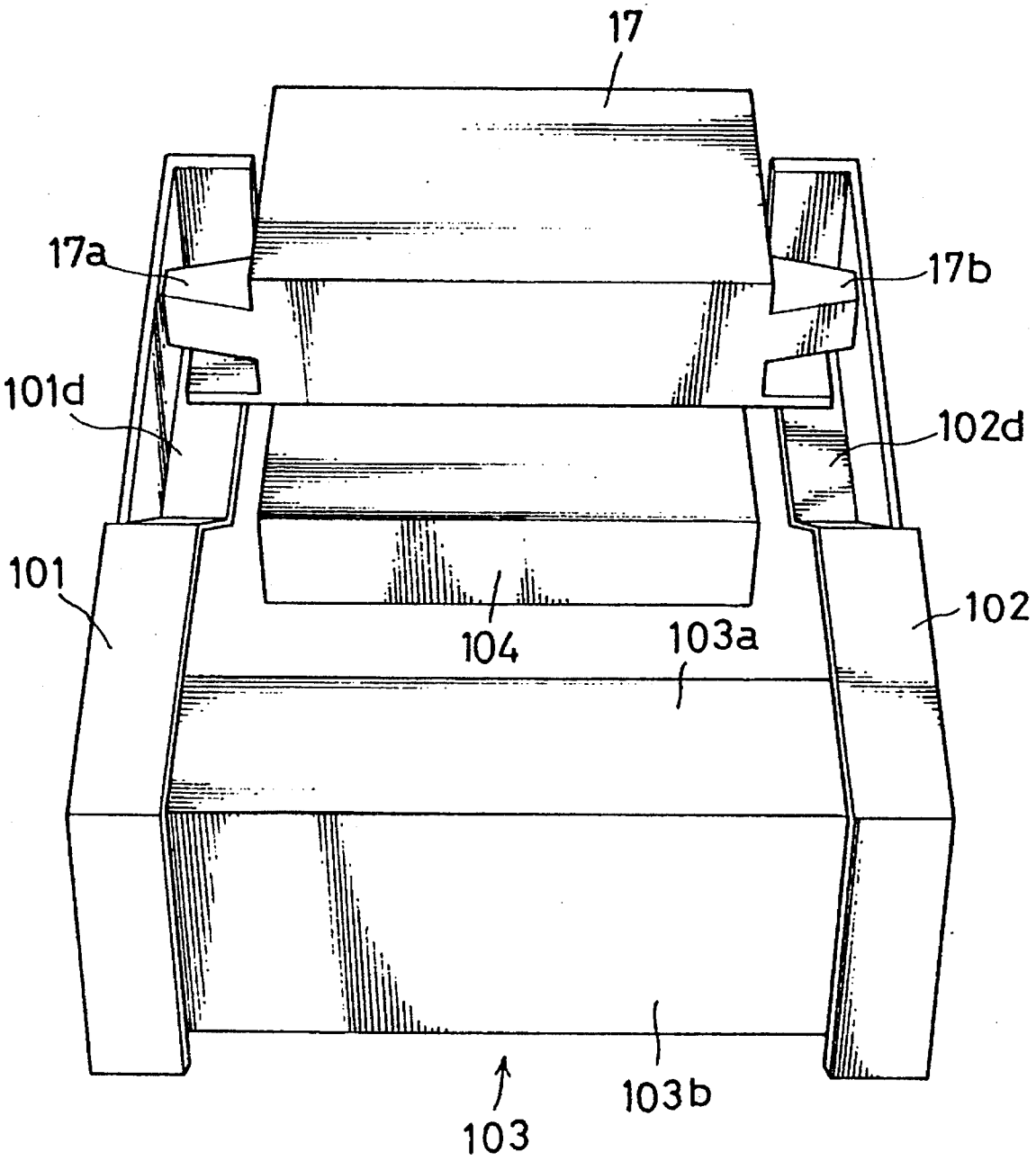
FIG. 7 is a perspective view showing mounting of an image reading means on the front and rear frame members.

Furthermore, the front frame member 101 and rear frame member 102 are reinforced by the image reading means 17 mounted in the upper body 10. This will be seen more specifically in the following. Referring to FIG. 7 showing a perspective view of a right side of the upper body 10 as viewed at an elevated angle, the image reading means 17 has projections 17*a* and 17*b* at both ends of its housing. The projections 17*a* and 17*b* are fittable in recesses 101*d* and 102*d* formed in the upper portions of the front frame member 101 and rear frame member 102, respectively. The projections 17*a* and 17*b* are fixedly attached by screws, for example, from the outside to hold the image reading means 17 on the upper body 10. Fixedly attached to the front frame member 101 and rear framing member 102 at the both ends, the image reading means 17 serves as stay for connecting the two frame members 101 and 102 together. The connection between the front frame member 101 and rear frame member 102 is made more rigid providing an enhanced anti-torsional effect.

As seen in the above discussion, the front frame member 101 and rear frame member 102 made of integrally molded resin members are connected together by a plurality of metal reinforcing members 103 to 106 at several points. This is why the front frame member 101 and rear frame member 102 are not easily deformed due torsional stresses which are likely to occur when swinging up and down the upper body 10 or when loading and removing the developing unit 12 or other internal modules.

Referring again to FIG. 3, there are provided at a left side of the upper body 10 a pair of fixing plates 13 and 13', each having a pivot shaft 14 projecting outward. On the other hand, there are provided a pair of supports 15 placed face to face with the fixing plates 13 and 13' at the left side of the lower body 11. Each support 15 has a through hole 151 fittable on the pivot shaft 14.

The upper body 10 is connected to the lower body 11 by inserting the pivot shafts 14 into the holes 151 in the supports 15. Accordingly, the right side of the upper body 10 can be swung up and down. Further, two coil springs 16, each having a helical winding in an intermediate portion, are mounted on the two pivot shafts 14. A lower end 16*a* of each coil spring 16 is hooked on a bent portion 152 of the supports 15. On the other hand, an upper end 16*b* of the coil spring 16 is fixedly attached on an appropriate position of the front frame member 101 or rear frame member 102. The resilient force of the coil spring 16 causes the upper body 10 to swing in the counterclockwise direction to a specified angle. With this arrangement, the right side of the main body 1 is opened to a convenient position when the locking mechanism is released by pushing up the release lever 9.

To close the main body 1 from its fully opened position, the right side of the upper body 10 should be pushed downward. When the upper body 10 is fully pushed down, it is automatically locked to the lower body 11. More specifically, the upper body 10 turns about the pivots 14 in the clockwise direction when its right side is pushed down. When the right side of the upper body 10 reaches the lower-most position, the swinging motion of the upper body 10 is curbed by the previously mentioned positioning member 107 and the upper body 10 is locked to the lower body 11 by the hook member 108.

Figure 8A:
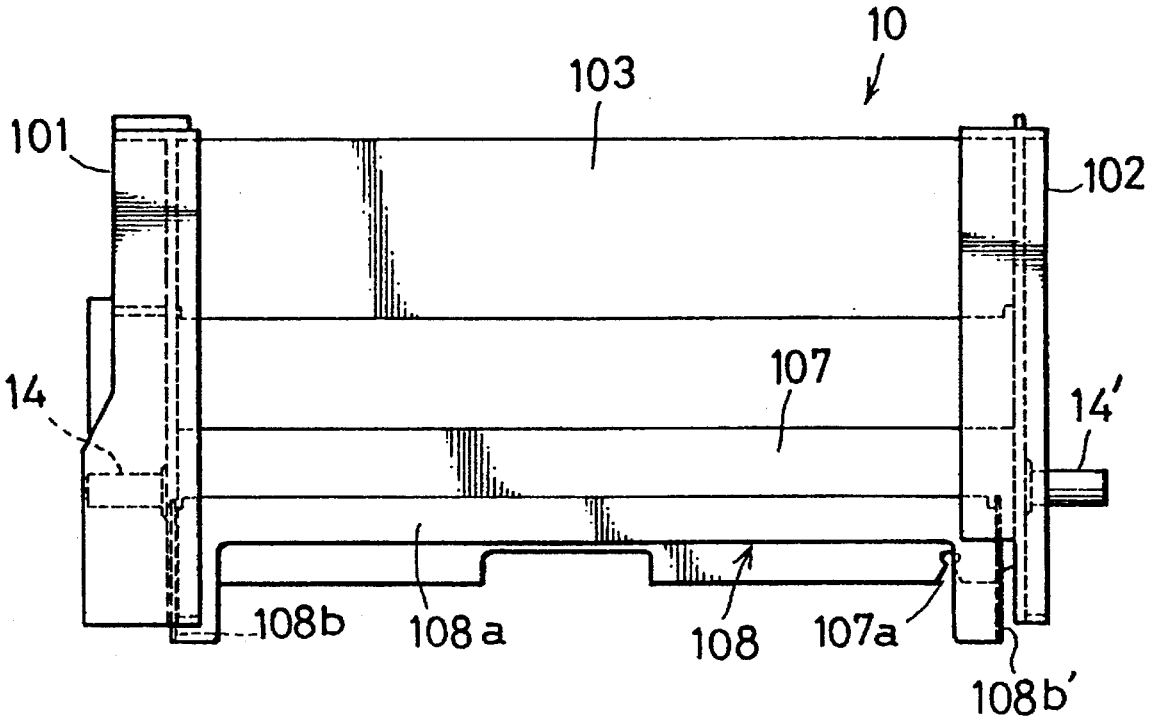
FIG. 8A is a right side elevation view of the upper body generally showing a construction of a positioning member and a hook member.
Figure 8B:
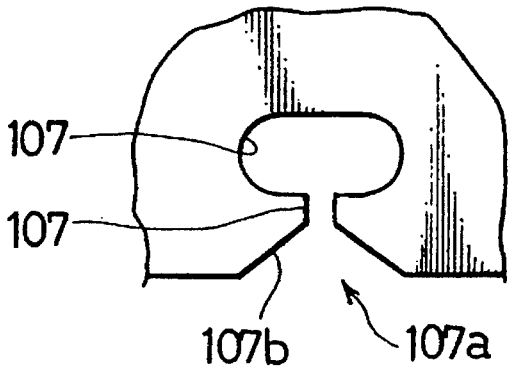
FIG. 8B is an enlarged view a portion of the positioning member showing a concave cutout.
Figure 9:
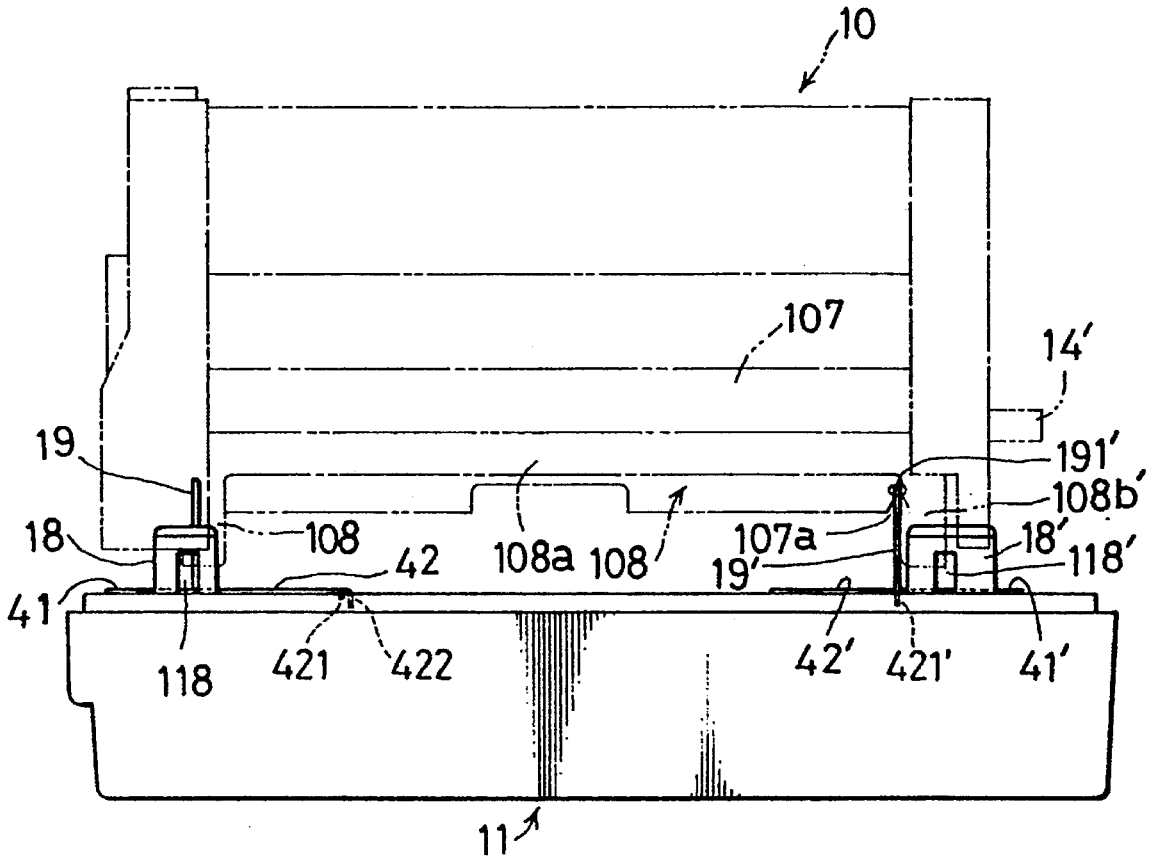
FIG. 9 is a right side view showing a locking mechanism between the under and lower bodies.
Figure 10:
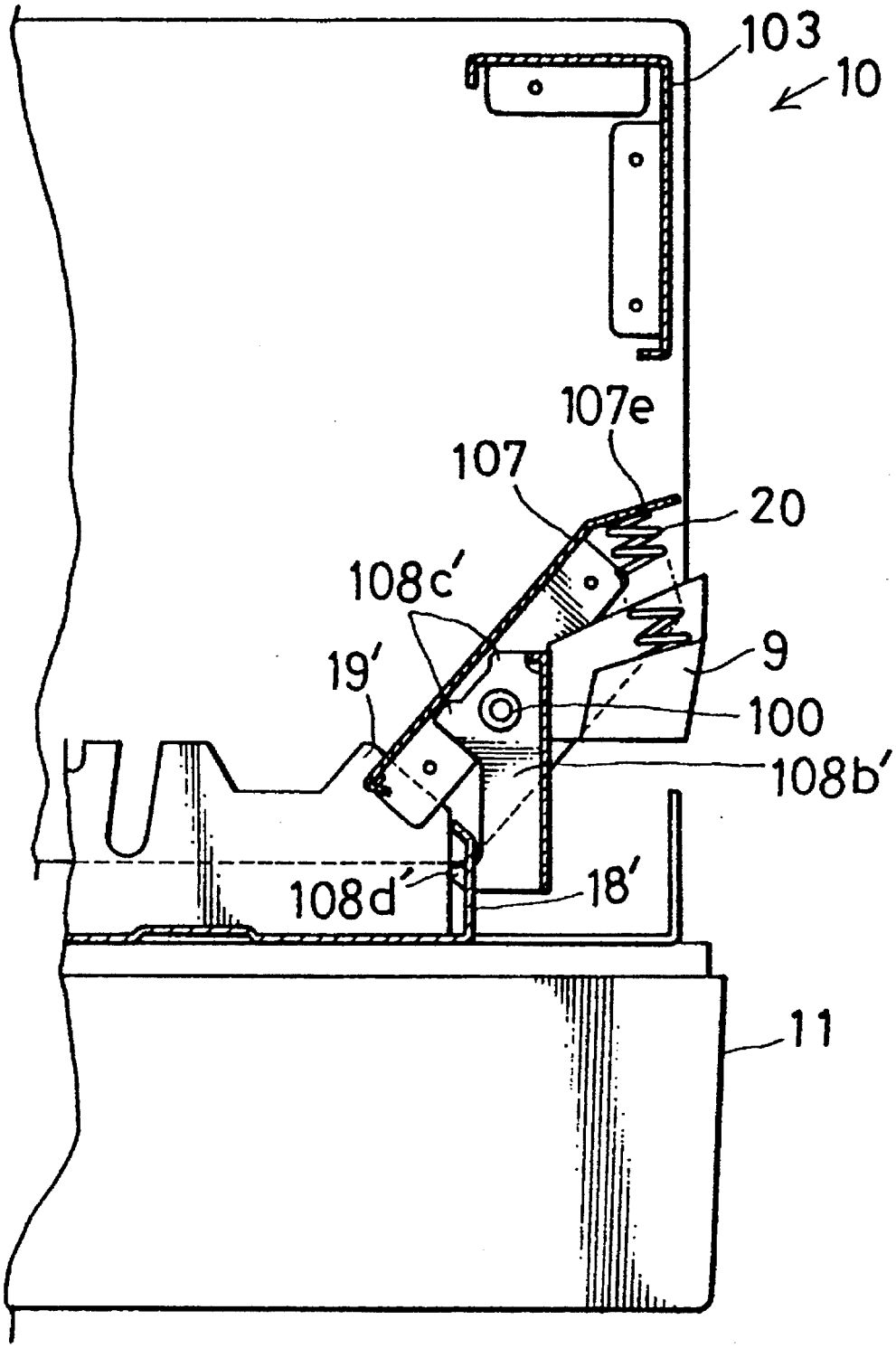
FIG. 10 is a partly cutaway front view of a portion of the upper body showing a construction of the positioning member and hook member.

FIGS. 8 through 10 are diagrams showing a construction of the positioning member 107 and hook member 108. FIG. 8A is a right side elevation view of the upper body 10 while FIG. 8B is a fragmentary enlarged view showing a concave cutout in the positioning member 107. FIG. 10 is a fragmentary front view of the upper body 10 partially in section. FIG. 9 is a fragmentary right side view showing the locking mechanism between the upper body 10 and lower body 11.

On a lower end of the positioning member 107, close to the rear frame member 102, there is formed a cutout 107*a* for regulating the descending upper body 10. The cutout 107*a* has fan-like portion 107*b* joining a narrow entry portion 107*c* and a hole portion 107*d* having a specified depth, as shown in FIG. 8B.

An upper end of the positioning member 107 is bent outward at a specified angle to form a slant portion 107*e*, as shown in FIG. 10. The lower end of the positioning member 107 is bent to the inside of the upper body 10 and fixed to the upper body 10.

The hook member 108 includes a connecting portion 108*a* of which front and rear ends are bent at right angles to form engaging ends 108*b*, and a pair of projections 108*c* close to its upper end, and a hook 108*d* at a lower end of the engaging end 108*b*. The projections 108*c* are properly located for regulating the angular movement of the hook member 108. The aforementioned release lever 9 is fixed at the center or other appropriate position of the connecting portion 108*a* as shown in FIG. 3.

The front and rear engaging ends 108*b* of the hook member 108 are mounted to the front frame member 101 and rear frame member 102 by pins 100 in such a manner that the hook member 108 can be turned outward and inward about the pins 100. There is also provided a spring 20 between the release lever 9 and the slant portion 107*e* of the positioning member 107 to push the release lever 9 down.

As seen in FIGS. 3 and 9, there are provided front and rear brackets 19 and 19' at appropriate positions in the upper portion of the lower body 11 for holding a pair of registration rollers 29 to be described later. Each of the brackets 19 and 19' is a one-piece metal member which made by cutting and bending a single metal plate into a specified shape. The front bracket 19 has an eyelet 18 for locking one of the engaging ends 108*b* of the hook member 108 and members 421 and 422 for positioning paper feed rollers to be described later. Similarly, the rear bracket 19' includes an eyelet 18' for locking the other engaging end 108*b* and a member 421' for positioning the paper feed rollers. The rear bracket 19' is additionally provided with a projection 191' fittable in the cutout 107*a* of the positioning member 107.

The eyelets 18 and 18', positioning members 421. 421' and 422 for the paper feed rollers 23 and the mounting mechanism of the registration rollers 29 will be described later in detail.

As the upper body 10 swings down in the clockwise direction, the projection 191' automatically fits into the cutout 107*a* of the positioning member 107 to set the lower-most position of the upper body 10 to prevent any displacement in the longitudinal direction.

As previously mentioned, the cutout 107*a* has the fan-like portion 107*b* and hole portion 107*d* . Accordingly, the projection 191' smoothly fits into the cutout 107*a* of the positioning member 107 even when they are inclined from each other. The projection 191' eventually hits against the far end of the cutout 107*a* to set the upper body 10 at the correct descending position.

It should be noted that the shape of the cutout 107*a* is not limited to the one shown in FIG. 8B as long as there are provided a narrow entry portion 107*c* for preventing horizontal displacement of the upper body 10 and an hole portion 107*d* for regulating the downward stroke. As another cutout of the present invention, it may be appropriate to form the hole portion into a long rectangular shape having almost the same width as the narrow entry portion 107*c*.

Further, it may be appropriate to provide the positioning member 107 on the lower body 11 and the projection 191' on the upper body 10.

Figure 11:
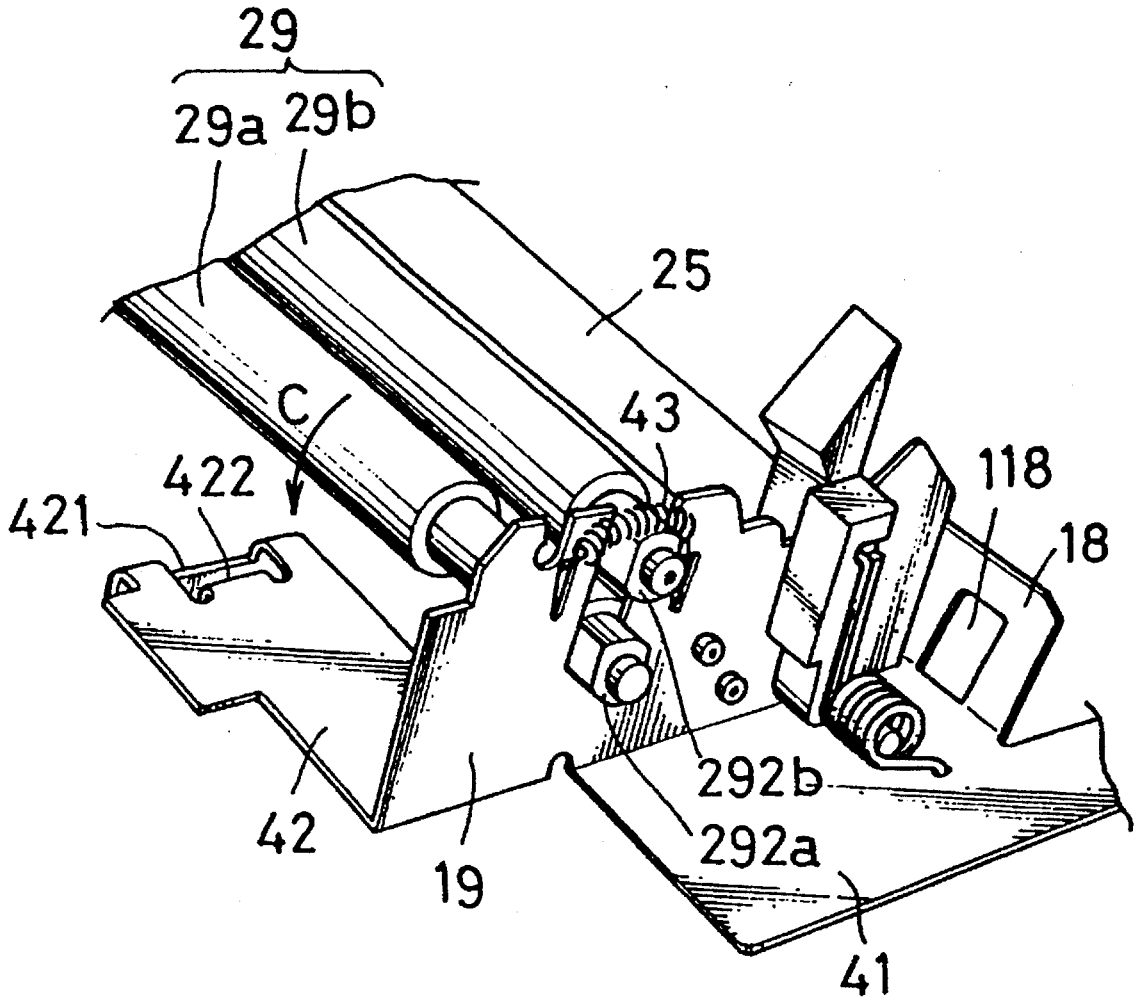
FIG. 11 is a perspective view showing a construction of a bracket on the front.

As shown in FIG. 11, the front bracket 19 has an outside base plate 41 and an inside base plate 42 individually bent at right angles to an upright portion of the bracket 19. Further, the outside base plate 41 has the aforementioned eyelet 18 bent toward the upright portion of the bracket 19. The rear bracket 19' also has an outside base plate 41', inside base plate 42', and eyelet 18' formed in similar manner. The eyelets 18 and 18' have eyes 118 and 118' at specified portions, respectively.

The hook member 108 is pushed inward by the resilient force of the spring 20 via the release lever 9 until the projections 108*c* of the engaging ends 108*b* come into contact with the positioning member 107, where the engaging ends 108*b* and 108*b'* are in an upright position. In this position, the hooks 108*d* and 108*d'* snap into the eyes 118 and 118', respectively, to lock the upper body 10 to the lower body 11. When the release lever 9 is lifted upward, the hook member 108 turns counterclockwise, causing the hooks 108*d* and 108*d'* to unlatched from the eyes 118 and 118' into an unlocked position.

As seen in the above description, when the upper body 10 turns clockwise about the pivot shaft 14 and the right side of the upper body 10 descends to a certain position, the projection 191' of the bracket 19' slips into the cutout 107*a* of the positioning member 107 to control the closing action of the upper body 10. Therefore, the above configuration prevents mutual displacement between the upper body 10 and the lower body 11 in the longitudinal and vertical directions, and the members carried by the bodies are exactly positioned to each other.

Referring again to FIG. 21, the document D placed on the document feeder tray 2 is fed from right to left (as shown by arrow A), scanned by the image reading means 17 located under the control panel 3, and discharged to the original discharge tray 5.

The image signal obtained by the image reading means 17 as it scans the document D is once stored in an internal memory (not illustrated) of the facsimile machine. The stored image signal is then read out for transmission or copying depending on the mode of facsimile transmission or copying.

More specifically, when the facsimile transmission mode is selected, the image signal is sequentially read out of the memory and transmitted to a facsimile machine of a desired recipient via a telephone line. When the copying mode, an image of the original document is formed on the copy sheet using the image signal read from the memory.

Figure 2:
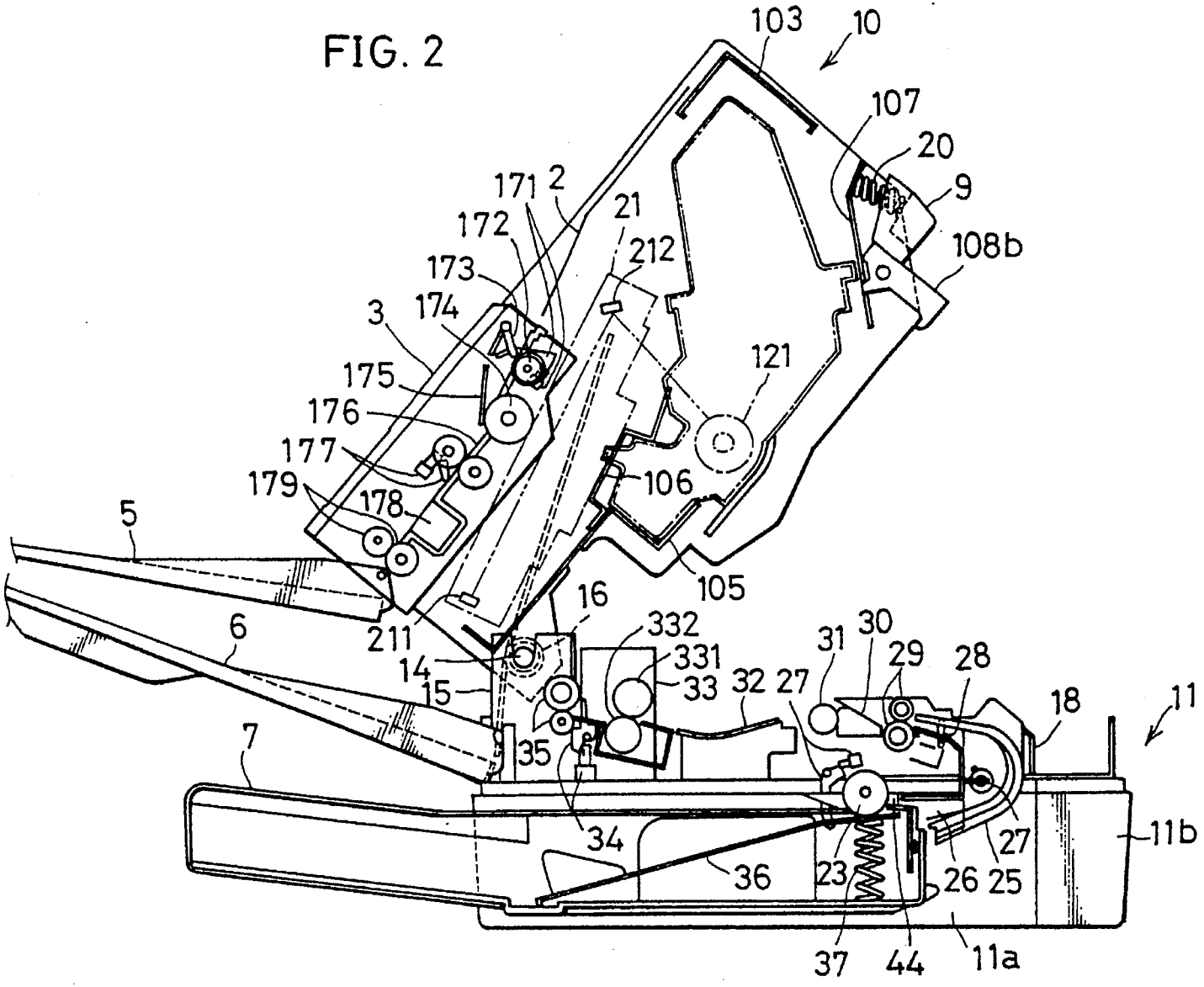
FIG. 2 is a diagram schematically showing the internal construction of the facsimile machine in an opened position.

Referring now to FIG. 1 showing an internal construction of the aforementioned facsimile machine in the closed state, and FIG. 2 showing the internal construction of the facsimile machine in the opened state, the main body of the facsimile machine carries the image reading means 17, image forming means 120 including the developing unit 12, optical unit 21, copy paper cassette 7, and paper feeding mechanism for feeding the copy paper sheet from the copy paper cassette 7 to the image forming means 120. As previously described, the main body 1 is opened almost along the horizontal paper path to assure easy access to the internal elements.

As already mentioned, the image reading means 17, the image forming means 120 and the optical unit 21 are arranged inside the upper body 10. The optical unit 21 scans an image of the document and send a light image to the photosensitive drum 121. The image forming unit 120 includes the photosensitive drum 121 and other peripheral elements including developing unit 12, cleaning unit and charger surrounding the photosensitive drum 121.

On the other hand, there are provided in the upper portion of the lower body 11 the paper feeding mechanism for feeding copy paper sheets from the copy paper cassette 7 to the photosensitive drum 121, transfer roller 31 pressed against the photosensitive drum 121 for transferring the toner image onto the copy paper sheet, transfer guide 32 for guiding the copy paper sheet to a fixing unit 33 after the transfer process. The fixing unit 33 includes a heating roller 331 and a pressure roller 332, and a pair of output rollers 35 for discharging the copy paper sheet to the copy paper sheet discharge tray 6 after fixing.

The paper feeding mechanism includes a guide member 24, a U-turn paper guide 25 and an upper paper guide 30 as well as the previously mentioned copy paper cassette 7, paper feed rollers 23 and a pair of registration rollers 29. The registration rollers 29, upper paper guide 30, transfer roller 31, transfer guide 32 and output rollers 35 together form the aforementioned horizontal paper path while the paper feed rollers 23, guide member 24 and U-turn paper guide 25 form a U-turn paper path for guiding the paper fed from the copy paper cassette 7 to the horizontal paper path upward.

Furthermore, there are provided copy paper sheet sensors 22, 28 and 34 at appropriate positions on the upstream of the paper feed rollers 23, registration rollers 29 and output rollers 35, respectively. The construction of the paper feeding mechanism will be described later in further detail.

The image forming means 120 is inserted through the passage 10*a* in the upper body 10. The image reading means 17 is mounted in an upper left position of the upper body 10 while the optical unit 21 is disposed beneath the image reading means 17.

In the image reading means 17 are provided, from upstream (starting from the document feeder tray 2), a document sensor 171, a document feed roller 172, a document presser 173, a paper separating roller 174, a separator plate 175, a pair of conveying rollers 176, a document sensor 177, an image sensing apparatus 178 and a pair of output rollers 179.

The document sensors 171 and 177 and the copy paper sheet sensors 22, 28 and 34 each are made of an photointerruptor and a shielding plate.

When the document sensor 171 detects a stack of original document sheets loaded on the document feeder tray 2, the document feed roller 172 feeds them into the image reading means 17. Only the lowermost sheet is separated by the separating roller 174 and separator plate 175 and sent forward to the conveying rollers 176 to enable reading or facsimile transmission. When a "start" command is entered, the conveying rollers 176 feed the document sheet to the image sensing device 178 at a specified speed.

The image sensing device 178 scans the document sheet being fed across a predetermined range and the resultant image signal is stored in the internal memory (not illustrated). While the document sheet is being read by the image sensing device 178, it is detected by the document sensor 177. The output of the document sensor 177 is used to judge that the reading process is in progress. The output is reset to a "zero" level when the rear edge of the original passes the document sensor 177. As a result, it is judged that the reading process has been finished. Then, the document sheet is discharged to the original document discharge tray 5 by the discharging rollers 179 and a next sheet of original document is sent to the conveying rollers 176. The stack of original document sheets are read one after another in the above-mentioned manner.

Provided with light emitting means 211 for producing laser beam, a polygon mirror (not illustrated) and a deflecting mirror 212 for directing the laser beam toward the photosensitive drum 121, the optical unit 21 projects the laser beam modulated by a digitized image signal onto the photosensitive drum 121 to produce a latent image on the drum surface.

In an intermediate portion of the left side of the lower body 11 is formed a mounting portion 11*a* for mounting the copy paper cassette 7. The lower body 11 also carries a circuit board compartment 11*b* at the right side for accommodating a power supply circuit. Inside the lower body 11, there are provided paper feed rollers 23 above a forward end of a paper push-up plate 36 of the copy paper cassette 7.

Figure 12:
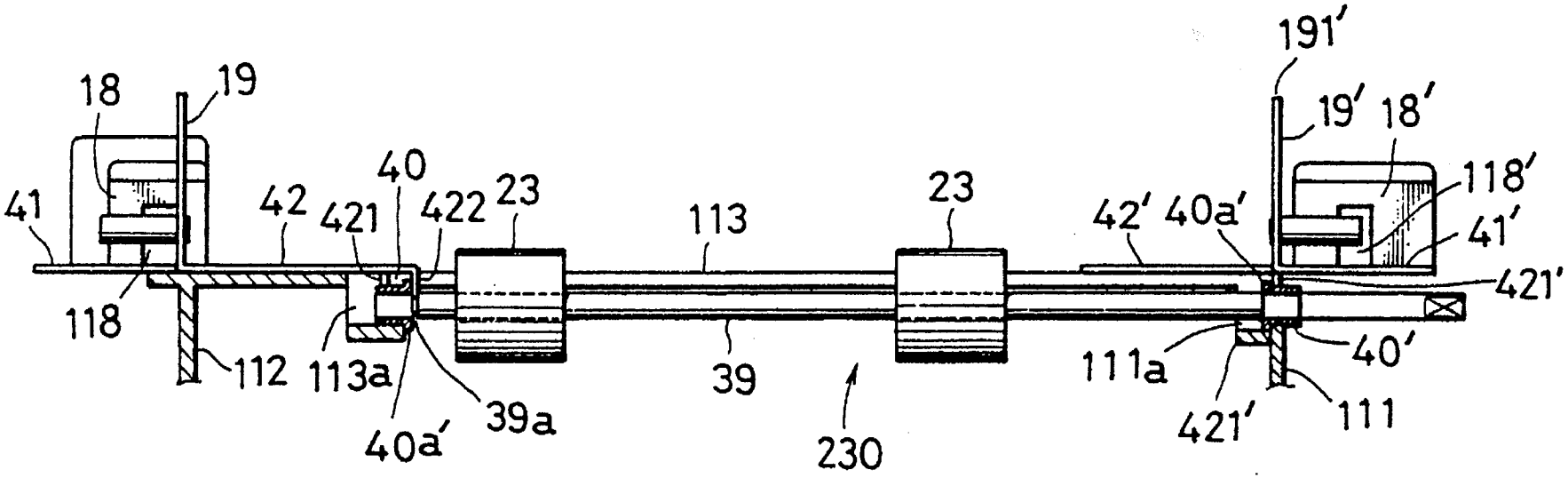
FIG. 12 is a sectional view showing mounting of paper feed rollers.

FIG. 12 is a fragmentary cross sectional view showing how the paper feed rollers 23 are mounted.

A feed roller assembly 230 includes a pair of paper feed rollers 23 separated from each other by a specified distance. The paper feed rollers 23 are fixedly attached on an intermediate portion of a rotating shaft 39 which is supported by bearings 40 and 40' at the left end and at a slightly inward position from the right end, respectively. The rotating shaft is formed with a circumferential groove 39*a* at portion close to the inside surface of the bearing 40. A driving gear (not illustrated) is mounted at the right end of the rotating shaft 39. On the other hand, there is a slot in a longitudinal direction at an appropriate position on a top plate 113 of the lower body 11. A pair of supports 113*a* and 111*a*, each having semi-circular cross section, are formed at a front end of the slot and at a slightly inward position from the rear end of the slot, respectively. The support 111*a* is located immediately above an upper end of the rear plate 111 of the lower body 11.

The paper feed roller assembly 230 is mounted at an appropriate position in relation to the copy paper cassette 7 in the lower body 11 by placing the bearings 40 and 40' on top of the supports 113*a* and 111*a*, respectively. Vertical and axial displacements of the feed roller assembly 230 are restricted by the brackets 19 and 19' attached to the lower body 11.

More specifically, the front bracket 19 has the previously mentioned positioning members 421 and 422 formed by bending down the inner ends of the inside base plate 42 as shown in FIG. 11. Similarly, the rear bracket 19' bas the positioning member 421' projecting downward from a position between the outside base plate 41' and inside base plate 42'.

When the front and rear brackets 19 and 19' are mounted at their respective positions on the top of the lower body 11, the positioning members 421 and 421' ride on top of the bearings 40 and 40', respectively. As a result, the positioning members 421 and 421' restrict vertical displacement of the rotating shaft 39. Also, the positioning member 422 fits into the groove 39*a* of the rotating shaft 39 to restrict axial displacement of the rotating shaft 39.

As seen above, the bearings 40 and 40' attached to the rotating shaft 39 of the paper feed rollers 23 are mounted by placing them on top of the supports 113*a* and 111*a* provided in the lower body 11. The paper feed roller assembly 230 can be easily mounted on the lower body 11. In the arrangement described above, the lower body 11 also carries the positioning members 421 and 421' formed in the base plates 42 and 42' of the brackets 19 and 19', respectively, for restricting vertical displacement of the bearings 40 and 40', the positioning member 422 formed in the inside base plate 42 for restricting axial displacement of the rotating shaft 39, and the supports 111*a* and 113*a* for restricting displacement of the bearings 40 and 40' in the paper feeding direction. Accordingly, the feed roller assembly 230 can be securely held in position with a simple mechanical structure.

Figure 13:
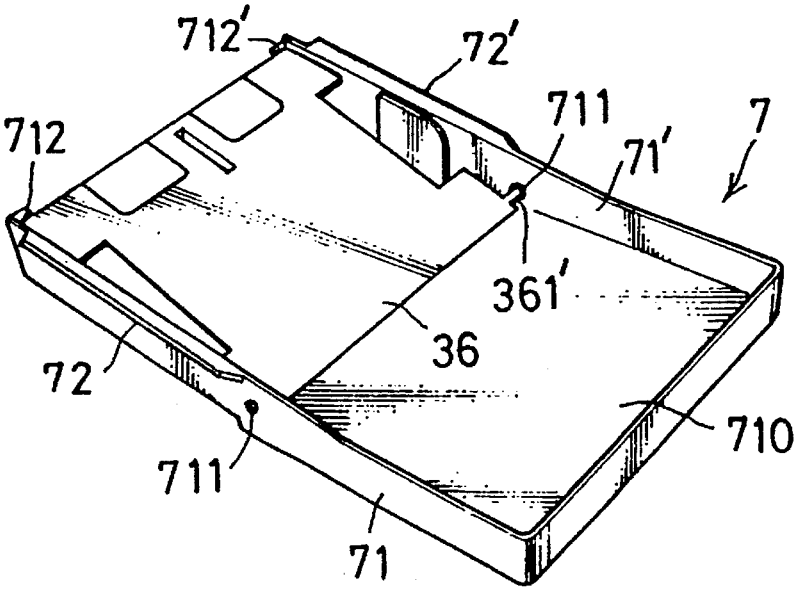
FIG. 13 is a perspective view showing a copy paper cassette.

FIG. 13 is a perspective view showing an external appearance of the copy paper cassette 7.

The copy paper cassette 7 is provided with guide plates 72 and 72' at forward portions of side members 71 and 71' which stand vertically on both sides of a bottom plate 710. In a forward half of the copy paper cassette 7, there is provided a paper push-up plate 36 made of an electrically conductive metal. The paper push-up plate 36 has a pair of projections 361 and 361' serving as pivots.

These pivots 361 and 361' are fitted into holes 711 and 711' in the side members 71 and 71', respectively, to serve as axis of rotation about which the paper push-up plate 36 can swing up and down. A forward portion of the paper push-up plate 36 is loaded on a spring 37 as shown in FIG. 1 in order to push up the corresponding area of cut sheets stacked in the copy paper cassette 7. It would be recognized, therefore, that the leading-end portion of the cut sheets is pressed against the bottom of the paper feed rollers 23. At an upper forward corners of the copy paper cassette 7, there are provided paper retaining tabs 712 and 712'. These tabs 712 and 712' align leading edges of the copy paper sheets and keep them within the copy paper cassette 7 as they are forced upward by the paper push-up plate 36.

Figure 14:
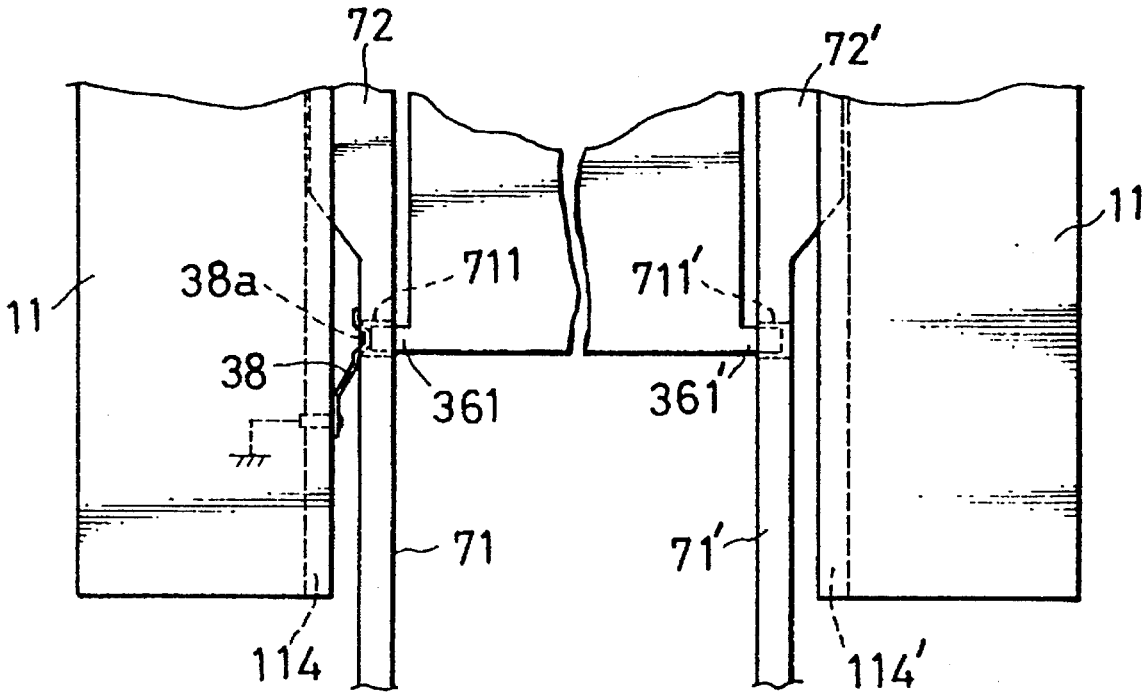
FIG. 14 is a plan view showing mounting of the copy paper cassette into the main body.

When the copy paper cassette 7 is inserted into the mounting portion 11*a* of the lower body 11, the guide plates 72 and 72' slide into guide grooves 114 and 114' formed on the inner walls of the lower body 11 as shown in FIG. 14. On an inner wall of the lower body 11, a leaf spring 38 is attached face to face with the side member 71 of the paper cassette 7. Made of an electrically conductive metal, the leaf spring 38 is grounded at one end with its foremost end 38*a* protruding into the space of the slot 11*a*. As the paper cassette is inserted into the slot 11*a*, the foremost end 38*a* of the leaf spring 38 slides along the side member 71 until it fits into the hole 711 in the side member 71. At this point, the leaf spring 38 presses against the pivot 361 of the paper push-up plate 36, whereby the paper push-up plate 36 is grounded via the leaf spring 38.

The above-mentioned construction which is simple in construction prevents accumulation of electrostatic charges in the paper push-up plate 36 that is likely to occur due to the friction between copy sheets when they are fed from the copy paper cassette 7. With this arrangement, electrostatic adhesion is effectively reduced to provide smooth feed of the copy paper sheets, preventing multi feeding of copy paper sheets from the paper cassette 7, jams in the paper path, and other paper handling problems.

Referring again to FIG. 1, on the downstream of the paper feed rollers 23, there are provided an angled guide member 24 and a U-turn paper guide 25 having a U-shaped cross section. The gently curved inner surface of the U-turn paper guide 25 faces the guide member 24 to provide a U-turn path for guiding the paper fed from the copy paper cassette 7 toward the registration guide rollers 29 provided above the paper feed rollers 23.

Figure 15:
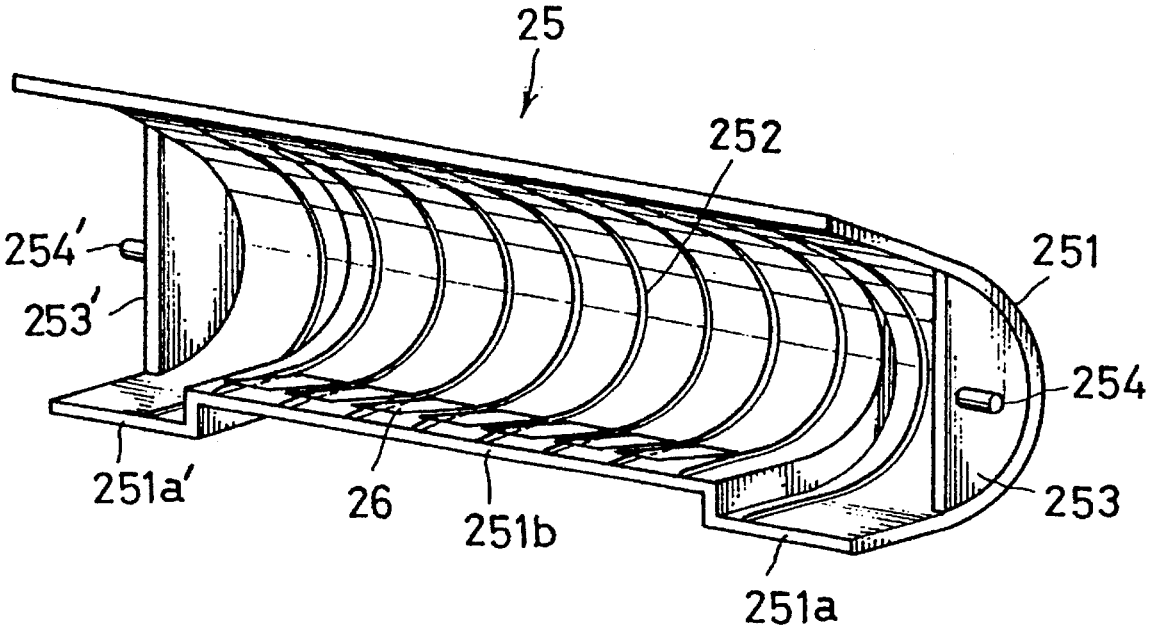
FIG. 15 is a perspective view showing a U-turn guide plate.

FIG. 15 is a perspective view showing an external appearance of the U-turn guide plate 25.

The U-turn paper guide 25 is formed into a roughly semi-cylindrical structure laving a U-shaped cross section. The U-turn paper guide 25 has slightly larger width than the copy paper sheet. A U-turn plate 251 is curved at predetermined curvature so that the copy paper sheet is guided along its inner surface. There are formed a plurality of parallel ribs 252 aligned in the paper feeding direction on the inner surface of the U-turn plate 251. The U-turn plate 251 is shaped in such a manner that its outside portions 251*a* and 251*a'* have a greater curvature than its central portion 251*b*. When mounted, an upper end (downstream) of the U-turn plate 251 becomes nearly horizontal. On the other hand, lower end (upstream) of the U-turn plate 251 is designed in the following manner. As seen in FIG. 15, the outside portions 251*a* and 251*a'* are stepped down from the central portion 251*b*. The outside portions 251*a* and 251*a'* of the U-turn paper guide 25 have a greater curvature than the central portion 251*b*.

When the paper feed rollers 23 feed the copy paper sheet from the paper cassette 7, its leading end goes into the U-turn paper guide 25. Since the outside portions 251*a* and 251*a'* are stepped down from the central portion 251*b*, the leading end of the copy paper sheet first gets into contact with the central portion 251*b* with its both corners free from the U-turn plate 251. Subsequently, the cut sheet is smoothly guided along the U-turn plate 251 as will be discusses in further detail in the following.

Copy paper sheets are apt to be creased at both corners on the leading end as they are retained in the copy paper cassette 7 by the paper retaining tabs 712 and 712'. When each sheet is pushed out by the paper feed rollers 23 from the copy paper cassette 7 onto the U-turn plate 251, the leading end corners or the sheet tend to hang down. Even in such situations, the sheet can be guided along the U-turn plate 251 without hitting the outside sections 251*a* and 251*a'* or being folded back at the hanging corners. It would be recognized that smooth feed of the copy paper sheet is achieved by the above-mentioned construction of the U-turn plate 251 having the stepped outside portions 251*a* and 251*a'* on both sides of the central portion 251*b*.

Furthermore, the upper portion of the U-turn plate 251 is formed to provide a straight paper path extending up to the point where the registration rollers 29 nip the copy paper sheet. Accordingly, while the paper slides along the inner surface of the U-turn plate 251, the leading end of the copy paper sheet is fed straight and caught in between the registration rollers 29. It would be appreciated, therefore, that the upper portion of the U-turn plate 251 designed in the manner described above can guide the leading end appropriately.

Figure 16:
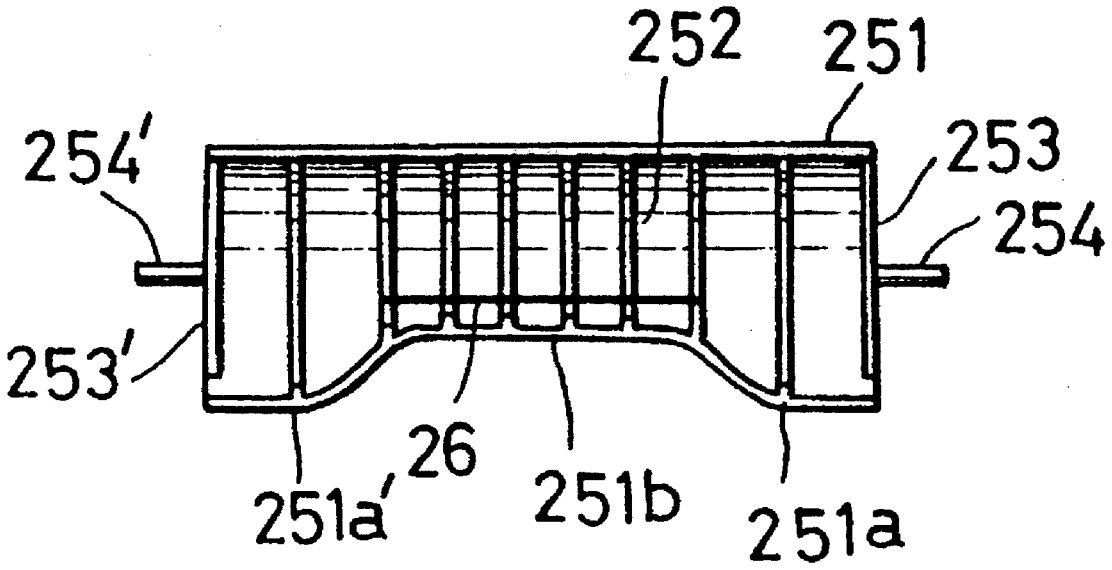
FIG. 16 is a plan view showing a modified U-turn guide plate.

It is to be noted in the above connection that the design of the U-turn plate 251 is not limited to the one indicated in FIG. 15 as long as the outside portions 251*a* and 251*a'* are lower than the central portion 251*b*. As an example, the outside portions 251*a* and 251*a'* of the U-turn plate 251 may be curved gradually downward from the central portion 251*b* as shown in FIG. 16.

Referring again to FIG. 15, the U-turn paper guide 25 is furnished with damping means 26 made of an elastic material. Attached to the inner surface of the U-turn plate 251 close to a lower end of its central portion 251b, the damping means 26 juts out in the upstream direction with its tips slightly raised. The damping means 26 is intended to prevent the paper from making noise as its trailing edge leaves the paper cassette 7 onto the U-turn plate 251.

Figure 17:
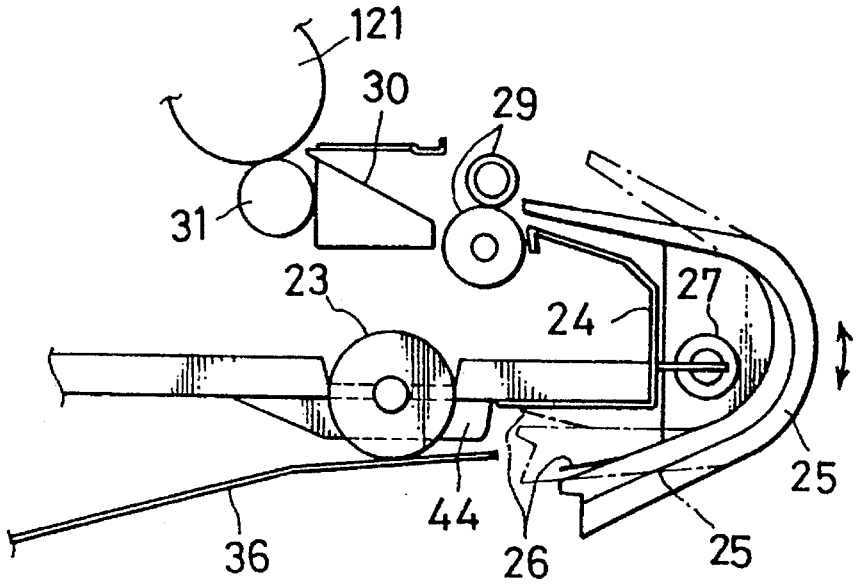
FIG. 17 is a side elevation view showing rotation of the U-turn guide plate.

The effect of the damping means 26 will be seen in more detail in the following. To provide smooth feed from the copy paper cassette 7 to the U-turn paper guide 25, the lower end of the U-turn paper guide 25 is positioned slightly below the end of the paper push-up plate 36 in the "out-of-paper" state as shown in FIG. 17. When the trailing end of the paper is just leaving the copy paper cassette 7, a forward half of the copy paper sheet is curled within the U-turn paper guide 25. When the trailing end of the paper is relieved of the paper push-up plate 36, the restive force of the paper causes the trailing end to hit against the lower end of the U-turn plate 251 due to the height difference between the paper push-up plate 36 and the U-turn paper guide 25. The damping means 26 absorbs the resultant impact and pass the trailing end onto the U-turn plate 251 without producing noise.

Furthermore, the U-turn paper guide 25 is provided with pivots 254 and 254' projecting outward from side members 253 and 253', respectively. Mounted on side members (not illustrated) of the lower body 11 by these pivots 254 and 254', the U-turn paper guide 25 can be turned as shown in FIG. 17 when the main body 1 is opened by lifting up the upper body 10. With this arrangement, jammed paper can be easily removed since the gap at the upper end of the U-turn paper guide 25 can be broadened by turning it clockwise as shown by phantom lines in FIG. 17.

Referring again to FIG. 1, a bottom portion 24*a* of the aforementioned guide member 24 serves as inside guide plate for guiding the copy paper sheet to the U-turn paper guide 25 as it is pushed out by the paper feed rollers 23 in an upper-right direction out of the copy paper cassette 7. On the other hand, a top portion 24*b* of the guide member 24 serves as inside guide plate for guiding the copy paper sheet along the U-turn paper guide 25 up to the registration rollers 29.

Figure 18:
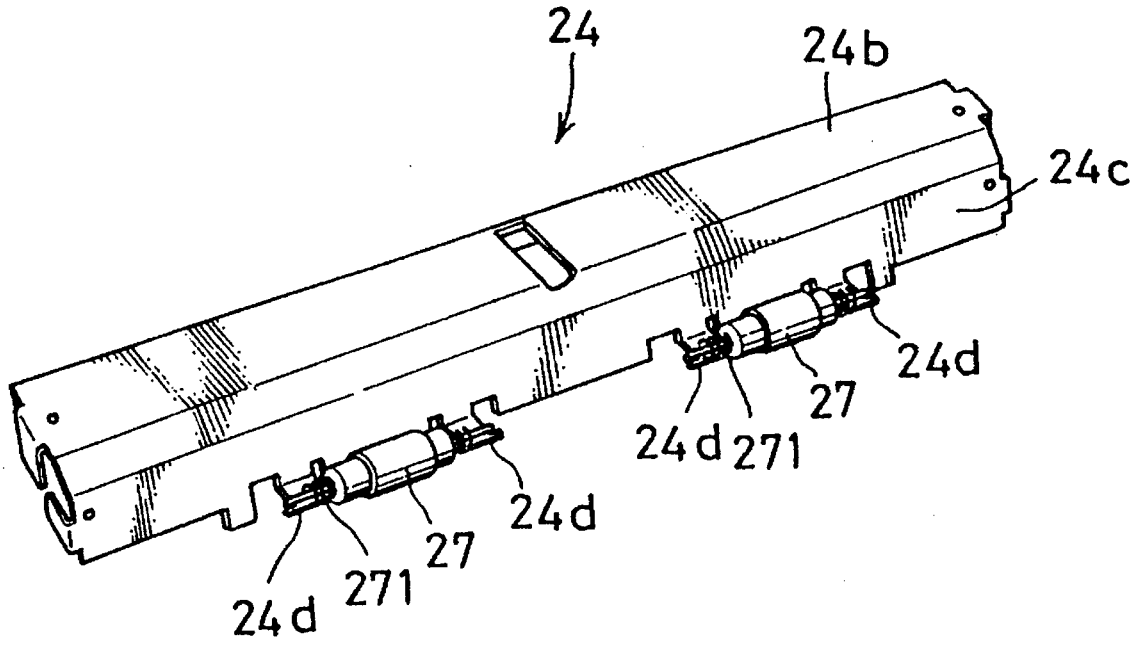
FIG. 18 is a perspective view showing rollers mounted on a vertical body of a guide plate.

To a vertical portion 24*c* of the guide member 24 are attached a pair of idle rollers 27, for example, at appropriate positions in a lengthwise direction of the guide member 24. For example, each or these rollers 27 is suspended by a coil spring mounted between supports 24*d* projecting from the lower end of the vertical section 24*c* as shown in FIG. 18. In this arrangement, the coil spring serves as a shaft 271 for each roller 27. Working together with the U-turn paper guide 25, the rollers 27 assures smooth inverting of the copy paper sheet. By using coil springs, the structure can be made lightweight and inexpensive. As a modified form, the shaft 271 may be made of a normal rod. Furthermore, the shafts 271 may be fitted tight or loose into the rollers 27.

Figure 19:
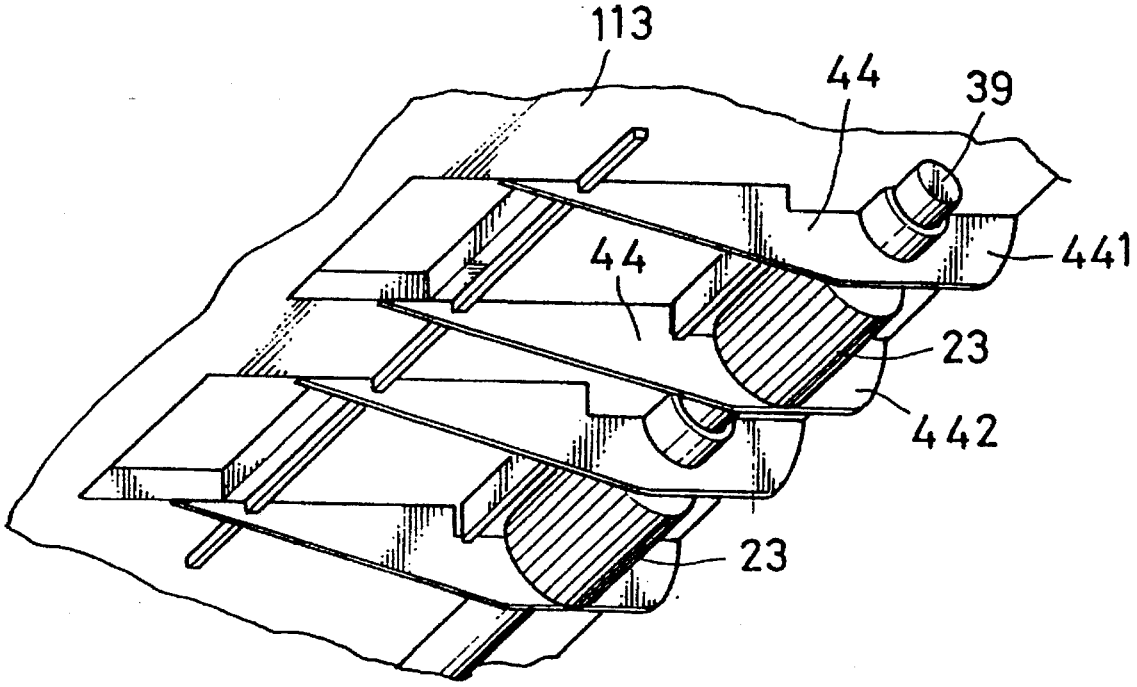
FIG. 19 is a perspective view showing a construction of paper guides provided at the paper feed rollers.

Referring now to FIG. 19, there are provided paper guides 44 aligned in parallel with the paper feeding direction of the individual paper feed rollers 23. These paper guides 44 may be formed as integral part of the top plate 113 of the lower body 11 or attached to the bottom of the top plate 113 at appropriate positions, as shown in FIG. 19. Each paper guide 44 is furnished with vertical guide plates 441 and 442 on both sides of the paper feed roller 23, having a tapered surface on the upstream and a horizontal surface having a specified length on the downstream. With this arrangement, the paper guides 44 serve to guide the copy paper sheet smoothly to the paper feed rollers 23 and to prevent the paper feed rollers 23 from entangling the copy paper sheet being fed or catching the paper again as it is pushed back from the U-turn paper guide 25. The feature of the paper guides 44 of preventing jams will be described later in further detail.

Figure 20A:
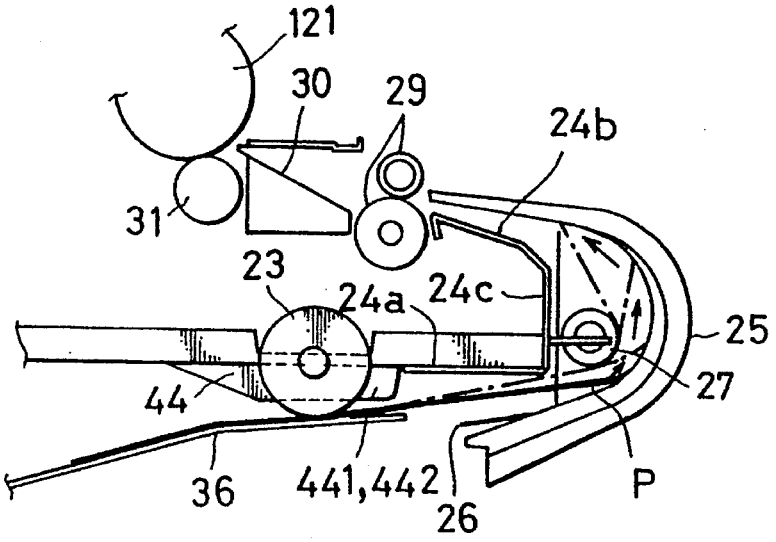
FIGS. 20A, 20B, and 20C are side elevation views showing paper feeding states, FIG.20A showing a state where the leading end of the copy paper sheet has just gone onto the U-turn guide plate, FIG. 20B showing a state where the leading end of the copy paper sheet is just nipped by a pair of registration rollers, and FIG. 20C showing a state where the copy paper sheet is being fed by the registration rollers.
Figure 20B:
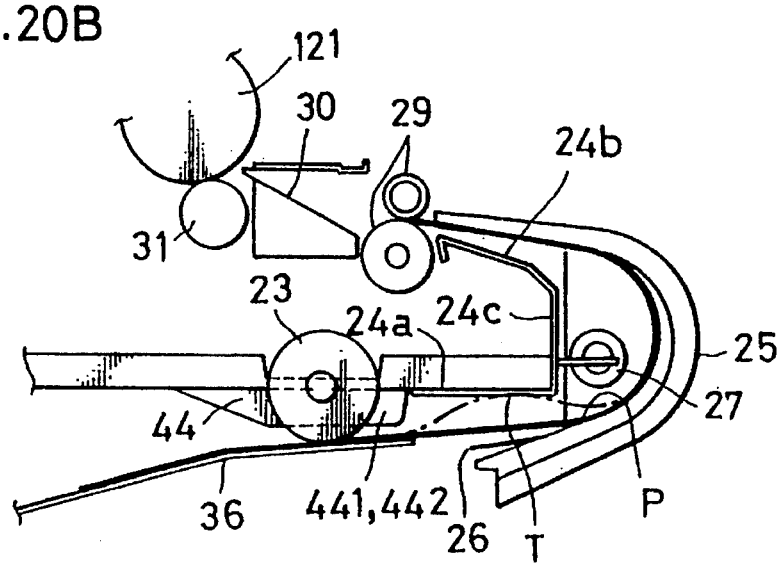
Figure 20C:
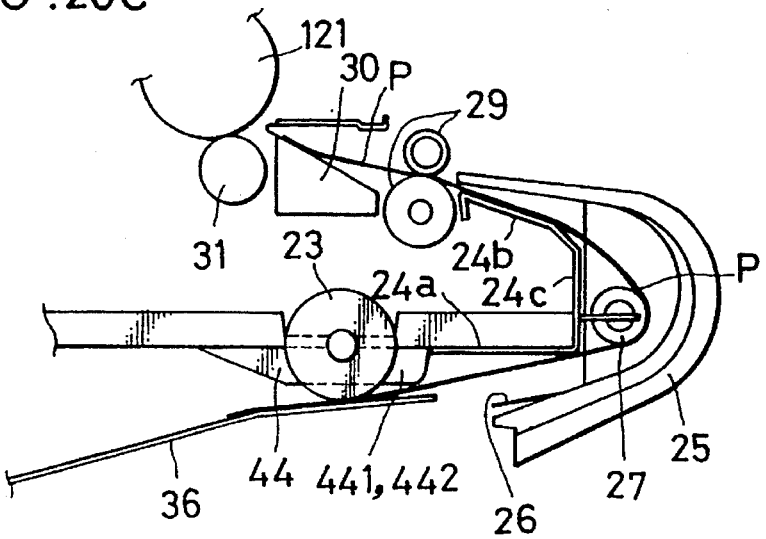

FIGS. 20A, 20B, and 20C are diagrams showing paper feeding states where the leading end of the copy paper sheet has just gone onto the U-turn guide plate 25, the leading end of the copy paper sheet is just nipped by the registration rollers 29, and the copy paper sheet is being fed by the registration rollers 29, respectively.

As the paper feed rollers 23 feed the copy paper sheet P from the copy paper cassette 7 into the U-turn paper guide 25, its leading end gets in contact with the U-turn plate 251. The leading end slides along the inner surface of the U-turn plate 251 and the feed direction is turned to a nearly opposite direction. At this point, an intermediate portion of the copy paper sheet P comes into contact with the rollers 27 and the copy paper sheet P is bent at the contact point as shown by phantom lines in FIG. 20A. While the copy paper sheet P is further conveyed, the copy paper sheet P is properly bent by the rotation of the rollers 27. Owing to the restive force of the bent portion of the copy paper sheet, the leading end of the copy paper sheet P is kept slightly pressed against the inner surface of the U-turn plate 251 all the way of the downstream portion of the rollers 27, allowing smooth and assured feeding up to the registration rollers 29.

While the copy paper sheet P is guided along the U-turn plate 251, the registration rollers 29 are kept in a stationary state The paper feed rollers 23 continue to rotate even after the leading end of the copy paper sheet P has gone into contact with the registration rollers 29. This causes a bulge T near the trailing end of the paper P, as shown by a phantom line in FIG. 20B, while an intermediate portion of the copy paper sheet is fitted to the shape of the U-turn plate 251 as illustrated.

The guide plates 441 and 442 of the paper guides 44 prevent the bulge T of the paper P from being pushed back and entangled by the paper feed rollers 23. Further, if the guide plates 441 and 442 are given a specified length on the downstream, the top of the bulge T will be pressed against the bottom body 24*a* of the guide member 24. As a result, the contact pressure at the leading end of the copy paper sheet P is regulated widthwise and skew or obliqueness of the paper P is thus eliminated.

The registration rollers 29 start rotating to feed the copy paper sheet P at a proper timing with the subsequent image transfer process. At this point, the copy paper sheet P again comes into contact with the rollers 27 and is guided smoothly along the top portion 24*b* of the guide member 24 as both the bottom portion 24*a* and rollers 27 give minimal friction.

It is to be recognized in connection with the above description that unless the guide member 24 is provided with the bottom portion 24*a*, an excessive bulge T will develop in the copy paper sheet P, causing its leading end to hit the inner surface of the U-turn plate 251 at a large contact angle. In this state, the paper P may buckle and jam directly at its bulged area, or go astray from the inner surface of the U-turn paper guide 25, resulting in an eventual jam. In the embodiment disclosed above, the guide member 24 is furnished with the low-friction, free-rotation rollers 27 in addition to the bottom body 24*a*. The rollers 27 guides the copy paper P smoothly onto the U-turn paper guide 25 without causing a bulge in the copy paper sheet P. In consequence, a desired bent is maintained in the copy paper sheet P, making it possible to guide the copy paper sheet P along the inner surface of the U-turn plate 251.

Referring again to FIG. 1, there are provided a pair of registration guide rollers 29 on the downstream of the guide member 24. The pair consists of a driving roller 29*a* and a driven roller 29*b* mounted on the brackets 19 and 19' (19' not illustrated) with bearings 292*a* and 292*b* attached to both ends of the respective rollers as shown in FIG. 11. More specifically, there are formed slotted cutouts 192 with U-shaped ends in the brackets 19 and 19' and the bearings 292*a* and 292*b* are fitted into these cutouts 192 in such a manner that the driving roller 29*a* is located on the bottom. The bearing 292*b* at each end of the driven roller 29*b* is pulled down toward the bottom of the slotted cutout 192 with a desired force by means of a spring 43 mounted across the opening of the slotted cutout 192. The springs 43 on the front and rear sides bold the registration guide rollers 29 in the slotted cutouts 192 and produce a pressure between the two rollers. This arrangement will stabilize the mutual positioning of the driving roller 29*a* and driven roller 29*b* and simplify their mounting structure.

With the above arrangement, the copy paper sheet is fed from the copy paper cassette 7 by means of the paper feed rollers 23 and conveyed along the U-turn paper guide 25 up to the registration rollers 29 provided above the paper feed rollers 23 before the image forming means performs the image forming of an image of facsimile transmission or original document. Thereafter, the registration rollers 29 feed the copy paper sheet to the photosensitive drum 121 in synchronism with the exposure timing of the optical unit 21, driving the transfer roller 31 to transfer a toner image from the photosensitive drum 121 to the copy paper sheet. Finally, the fixing unit 33 fixes the toner image on the copy paper sheet and the discharge rollers 35 discharge the copy paper sheet to the copy paper sheet discharge tray 6.

What is claimed is:

1. A paper feeding device for use in an image forming apparatus comprising;

paper supplying means for supplying a sheet; and a paper inverting portion for inverting the supplied sheet, the inverting portion having a substantially C-shaped inner guide surface, said substantially C-shaped inner guide surface defining a substantially C-shaped inner space, said paper inverting portion including a first end wall and a second end wall, said first and second end walls extending into said C-shaped inner space, pivot pins provided on said first and second end walls respectively and defining a pivot axis extending through said C-shaped inner space, said pivot pins being adapted for pivotally mounting the paper inverting portion on the image forming apparatus.

2. A sheet feeding device according to claim 1 wherein said C-shaped space has a generally central axis, said pivot axis being substantially coincident with said central axis.

3. A paper feeding device for use in an image forming apparatus comprising:

paper supplying means for supplying a sheet;

a paper inverting portion for inverting the supplied sheet, the inverting portion having an inner guide surface curved substantially in a C-shape;

a roller provided near and along an upstream end of the paper inverting portion facing the inner guide surface of the paper inverting portion; and a coil spring for mounting the roller on the image forming apparatus.

4. A paper feeding device for use in an image forming apparatus comprising:

paper supply means for supplying a sheet having leading edge corners;

a paper inverting means for inverting the supplied sheet, said paper inverting means having an inner guide surface having a substantially C-shaped configuration;

said paper inverting means having an upstream end section and a downstream end section, said upstream end section having a first end portion spaced from a second end portion and an intermediate portion between said first and second end portions, the distance between said first and second end portions being substantially equal to the width of said sheet; and step means on said first and second end portions offset relative to said intermediate portion to prevent the leading edge corners of said sheet from contacting said upstream end section of said paper inverting means as said sheet is fed to said paper inverting means by said supply means, said step means having a curvature greater than said intermediate portion.

5. A paper feeding device according to claim 4 wherein said paper inverting means includes a plurality of ribs spaced from one another in a widthwise direction of the copy paper sheet, said ribs having an inner guide surface with a substantially C-shaped configuration.

6. A paper feeding device according to claim 4 wherein said substantially C-shaped guide surface has a curvelinear section and a downstream flat section, said registration roller means being disposed juxtaposed to said downstream flat section, said downstream flat section defining a straight line path for said sheet such that the sheet is fed along said straight line to a nip of said registration roller means.

7. A paper feeding device according to claim 4 wherein said paper inverting means further comprising an elastic member on an upstream end of the inner guide surface of the paper inverting means, said elastic member being positioned so as not to come into contact with the leading edge of said sheet, said elastic member being operable to contact the trailing edge of said sheet.

8. A paper feeding device for use in an image forming apparatus comprising;

paper supplying means for supplying a sheet;

paper inverting means for inverting the supplied sheet, said inverting means having an inner guide surface curved substantially in a C-shape, said inverting means having an upstream end portion;

registration roller means provided on a downstream side of said inverting means, said registration roller means being operable to be held stationary for a period of time and to be rotated after said period of time has elapsed;

feed roller means provided on an upstream side of said inverting means; and a guide member spaced from said upstream end portion of said inverting means to define a bulge space between said upstream edge portion and said guide member, said feed roller means being operable to feed a sheet past said inverting means to said registration roller means such that when said registration roller means is held temporary stationary for said period of time, said sheet being continued to be fed by said feed roller means will cause the fed sheet to form a bulge in said bulge space and to cause said bulge to come into contact with said guide member, whereby the contact pressure at the leading edge of the sheet is thereby adjusted widthwise and skewing of the sheet is prevented.

9. A paper feeding device according to claim 8 wherein said substantially C-shaped guide surface has a curvelinear section and a downstream flat section, said registration roller means being disposed juxtaposed to said downstream flat section, said downstream flat section defining a straight line path for said sheet such that the sheet is fed along said straight line path to a nip of said registration roller means.

10. A sheet feeding device according to claim 9 wherein said guide member is disposed upstream of said roller means, said guide member being operable to determine the extent of the bulge of said sheet.

11. A paper feeding device according to claim 8 wherein said paper inverting means further comprises a roller means spaced from said inner guide surface, said roller means contacting an intermediate portion of said sheet and cooperating with said curvelinear surface to facilitate inverting of said sheet as said sheet passes through said inverting means.

12. A sheet feeding device according to claim 11 wherein said guide member is disposed upstream of said roller means, said guide member being operable to determine the extent of the bulge of said sheet.

13. A paper feeding device according to claim 12 wherein said substantially C-shaped guide surface has a curvelinear section and a downstream flat section, said registration roller means being disposed juxtaposed to said downstream flat section, said downstream flat section defining a straight line path for said sheet such that the paper is fed along said straight line path to a nip of said registration roller means.

14. A paper feeding device for use in an image forming apparatus comprising:

paper supplying means for supplying a sheet;

paper inverting means for inverting the supplied sheet, said inverting means having an inner guide surface curved substantially in a C-shape, said inverting means having an upstream end portion;

registration roller means provided on a downstream side of said inverting means;

feed roller means provided on an upstream side of said inverting means;

a guide member spaced from said upstream end portion of said inverting means to define a bulge space between said upstream edge portion and said guide member, said feed roller means being operable to feed a sheet past said inverting means to said registration roller means such when said registration roller means is held temporary stationary, said sheet being continued to be fed by said feed roller means will cause the fed sheet to form a bulge in said bulge space and to cause said bulge to engage said guide member, whereby the contact pressure at the leading edge of the sheet is thereby adjusted widthwise and skewing of the sheet is prevented;

said paper inverting means further comprising an elastic member on an upstream end of the inner guide surface of said paper inverting means, said elastic member being positioned so as not to come into contact with the leading edge of said sheet, said elastic member being operable to contact the trailing edge of said sheet.

15. A sheet feeding device according to claim 14 wherein said elastic member has an upstream end spaced from the inner guide surface of said paper inverting means.

16. A sheet feeding device according to claim 14 wherein said elastic means are provided at an intermediate portion of said inverting means.

17. A paper feeding device for use in an image forming apparatus comprising:

paper supplying means for supplying a sheet;

paper inverting means for inverting the supplied sheet, said inverting means having an inner guide surface curved substantially in a C-shape, said inverting means having an upstream end portion;

registration roller means provided on a downstream side of said inverting means;

feed roller means provided on an upstream side of said inverting means;

a guide member spaced from said upstream end portion of said inverting means to define a bulge space between said upstream edge portion and said guide member, said feed roller means being operable to feed a sheet past said inverting means to said registration roller means such when said registration roller means is held temporary stationary, said sheet being continued to be fed by said feed roller means will cause the fed sheet to form a bulge in said bulge space and to cause said bulge to engage said guide member, whereby the contact pressure at the leading edge of the sheet is thereby adjusted widthwise and skewing of the sheet is prevented;

said paper supplying means including:

paper storage means for storing the sheets;

feed roller means provided in the widthwise direction of the sheet operable to contact the copy paper sheet stored in the paper storage means for feeding the sheet to the paper inverting means;

paper guide means provided downstream of the feed roller means and higher than the lowermost surface of the feed roller means, the paper guide means extending to such a downstream position as to prevent the sheet from bending when a leading end of the sheet comes into contact with the inner guide surface of the paper inverting means.

18. A sheet feeding device according to claim 17 wherein said paper inverting means comprises a roller means spaced from said inner guide surface, said guide member being disposed upstream of said roller means, said guide member being operable to determine the extent of the bulge of said sheet.

19. A sheet feeding apparatus comprising:

sheet supply means for supplying a sheet having leading edge corners;

sheet inverting means for inverting the supplied sheet, said sheet inverting means having an inner guide surface having a substantially C-shaped configuration;

said sheet inverting means having an upstream end section and a downstream end section, said upstream end section having a first end portion spaced from a second end portion and an intermediate portion between said first and second end portions, the distance between said first and second end portions being substantially equal to the width of said sheet; and step means on said first and second end portions offset relative to said intermediate portion to prevent the leading edge corners of said sheet from contacting said upstream end section of said sheet inverting means as said sheet is fed to said sheet inverting means by said supply means.

20. A paper feeding device for use in an image forming apparatus comprising:

paper supply means for supplying a sheet;

a paper inverting means for inverting the supplied sheet, said paper inverting means having an inner guide surface having a substantially C-shaped configuration;

said paper inverting means having an upstream end section and a downstream end section, said paper inverting means comprising damping means for preventing the sheet from making noise at its trailing edge, said damping means comprising an elastic member on said upstream end of the inner guide surface of said paper inverting means, said elastic member being positioned so as not to come into contact with the leading edge of said sheet, said elastic member being operable to contact the trailing edge of said sheet.

21. A paper feeding device for use in an image forming apparatus comprising:

paper supplying means for supplying a sheet;

paper inverting means for inverting the supplied sheet, said inverting means having an inner guide surface curved substantially in a C-shape, said inverting means having an upstream end portion;

registration roller means provided on a downstream side of said inverting means;

feed roller means provided on an upstream side of said inverting means;

a guide member spaced from said upstream end portion of said inverting means to define a bulge space between said upstream edge portion and said guide member, said feed roller means being operable to feed a sheet past said inverting means to said registration roller means such when said registration roller means is held temporary stationary, said sheet being continued to be fed by said feed roller means will cause the fed sheet to form a bulge in said bulge space and to cause said bulge to engage said guide member, whereby the contact pressure at the leading edge of the sheet is thereby adjusted widthwise and skewing of the sheet is prevented;

said substantially C-shaped guide surface having a curvilinear section and a downstream flat section, said registration roller means being disposed juxtaposed to said downstream flat section, said downstream flat section defining a straight line path for said sheet such that the sheet is fed along said straight line path to a nip of said registration roller means;

said guide member being disposed upstream of said roller means, said guide member being operable to determine the extent of the bulge of said sheet;

said paper supplying means including:

paper storage means for storing the sheets;

feed roller means provided in the widthwise direction of the sheet operable to contact the sheet stored in the paper storage means for feeding the sheet to the paper inverting means;

paper guide means provided downstream of the feed roller means and higher than the lowermost surface of the feed roller means, the paper guide means extending to such a downstream position as to prevent the sheet from bending when a leading end of the sheet comes into contact with the inner guide surface of the paper inverting means.

22. A paper feeding device for use in an image forming apparatus comprising:

paper supplying means for supplying a sheet;

paper inverting means for inverting the supplied sheet, said inverting means having an inner guide surface curved substantially in a C-shape, said inverting means having an upstream end portion;

registration roller means provided on a downstream side of said inverting means;

feed roller means provided on an upstream side of said inverting means;

a guide member spaced from said upstream end portion of said inverting means to define a bulge space between said upstream edge portion and said guide member, said feed roller means being operable to feed a sheet past said inverting means to said registration roller means such when said registration roller means is held temporary stationary, said sheet being continued to be fed by said fee roller means will cause the fed sheet to form a bulge in said bulge space and to cause said bulge to engage said guide member, whereby the contact pressure at the leading edge of the sheet is thereby adjusted widthwise and skewing of the sheet is prevented;

said paper inverting means further comprising a roller means spaced from said inner guide surface, said roller means contacting an intermediate portion of said sheet and cooperating with said curvilinear surface to facilitate inverting of said sheet as said sheet passes through said inverting means;

said guide member being disposed upstream of said roller means, said guide member being operable to determine the extent of the bulge of said sheet;

said paper supplying means including;

paper storage means for storing the sheets;

feed roller means provided in the widthwise direction of the sheet operable to contact the sheets stored in the paper storage means for feeding the sheet to the paper inverting portion;

paper guide means provided downstream of the feed roller means and higher than the lowermost surface of the feed roller means, the paper guide means extending to such a downstream position as to prevent the sheet from bending when a leading end of the sheet comes into contact with the inner guide surface of the paper inverting means.

23. A paper feeding device for use in an image forming apparatus comprising paper supplying means for supplying a sheet and a paper inverting means for inverting the supplied sheet, said paper inverting means comprising an elongated C-shaped guide having a transverse cross section with a substantially C-shaped configuration, said C-shaped guide defining an inner space included within the C-shaped configuration, said C-shaped guide having a first end wall and a second end wall, each of said first and second end walls having end wall sections extending within said inner space included within the C-shaped configuration, pivot pins on said end wall sections defining a pivot axis extending within said inner space included within the C-shaped configuration, said pivot pins being adopted for pivotally mounting said C-shaped guide on an image forming apparatus for pivotal movement about said pivot axis.

24. A paper feeding device for use in an image forming apparatus comprising:

paper supplying means for supplying a sheet;

paper inverting means for inverting the supplied sheet, said inverting means having an inner guide surface curved substantially in a C-shape, said inverting means having an upstream end portion;

registration roller means provided on a downstream side of said inverting means;

feed roller means provided on an upstream side of said inverting means; and guide means spaced from said upstream end portion of said inverting means to define a bulge space between said upstream edge portion and said guide means, said feed roller means being operable to feed a sheet past said inverting means to said registration roller means such that when said registration roller means is held temporary stationary, said sheet being continued to be fed by said feed roller means will cause the fed sheet to form a bulge in said bulge space whereby the contact pressure at the leading edge of the sheet is thereby adjusted widthwise and skewing of the sheet is prevented, said guide means having a limiting engaging means operable to engage the bulge as the bulge is being formed in said bulge space to limit the size of the bulge.

25. A paper feeding device according to claim 24 wherein said limiting engaging means overlies said bulge.

26. A paper feeding device according to claim 24 wherein said inverting means has a downstream end portion which at least partially underlies said limiting engaging means.

27. A paper feeding device according to claim 24 wherein said feed roller means is provided with a plurality of spaced guide plates each disposed perpendicular to the axis of rotation of said feed roller means, said feed roller means having an outer periphery, each of said guide plates extending radially outwardly of the outer periphery of said feed roller means, each of said guide plates having guide edges disposed radially outwardly of the outer periphery of said feed roller means, said guide edges being operable to engage said sheet to prevent the bulge of the sheet from being pushed back and entangled with said feed roller means.

* * * * *